US009223240B2

(12) United States Patent
Kenmoku et al.

(10) Patent No.: US 9,223,240 B2
(45) Date of Patent: Dec. 29, 2015

(54) TONER

(75) Inventors: Takashi Kenmoku, Mishima (JP); Hitoshi Itabashi, Yokohama (JP); Akane Masumoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/343,662

(22) PCT Filed: Sep. 5, 2012

(86) PCT No.: PCT/JP2012/073245

§ 371 (c)(1),
(2), (4) Date: Mar. 7, 2014

(87) PCT Pub. No.: WO2013/035885

PCT Pub. Date: Mar. 14, 2013

(65) Prior Publication Data

US 2014/0205943 A1 Jul. 24, 2014

(30) Foreign Application Priority Data

Sep. 9, 2011 (JP) ..... 2011-196807

(51) Int. Cl.
*G03G 9/08* (2006.01)
*G03G 9/097* (2006.01)
*G03G 9/087* (2006.01)

(52) U.S. Cl.
CPC ..... *G03G 9/09783* (2013.01); *G03G 9/0806* (2013.01); *G03G 9/08704* (2013.01); *G03G 9/08706* (2013.01); *G03G 9/08708* (2013.01); *G03G 9/08722* (2013.01); *G03G 9/08791* (2013.01); *G03G 9/08795* (2013.01); *G03G 9/08797* (2013.01)

(58) Field of Classification Search
CPC ..... G03G 9/09783; G03G 9/08722
USPC ..... 430/108.3
See application file for complete search history.

(56) References Cited

U.S. PATENT DOCUMENTS

| | | | | |
|---|---|---|---|---|
| 5,232,809 | A * | 8/1993 | Anzai et al. | 430/108.3 |
| 2013/0065174 | A1* | 3/2013 | Itabashi et al. | 430/108.3 |

FOREIGN PATENT DOCUMENTS

| | | | |
|---|---|---|---|
| JP | 7-152207 | A | 6/1995 |
| JP | 8-006297 | A | 1/1996 |
| JP | 2002-287429 | A | 10/2002 |
| JP | 2003-96170 | A | 4/2003 |
| JP | 2003-215853 | A | 7/2003 |
| JP | 2004-219507 | A | 8/2004 |
| JP | 2010-185907 | A | 8/2010 |
| JP | 2011-137947 | A | 7/2011 |
| JP | 2011-137969 | A | 7/2011 |

* cited by examiner

*Primary Examiner* — Mark A Chapman
(74) *Attorney, Agent, or Firm* — Canon U.S.A. Inc., IP Division

(57) ABSTRACT

Since a charge amount of a toner and a charge rise characteristic thereof are liable to be influenced by the change in temperature and humidity condition, the change in image density occurs in printing, and in particular, in high temperature and high humidity environment, inconveniences, such as image fogging, occur due to non-uniformity of the charge amount distribution. In a toner including toner particles obtained by dispersing a monomer composition containing a polymerizable monomer and a colorant in an aqueous medium to form droplets and polymerizing the polymerizable monomer in the droplets, the toner particles contain a polymer formed by a polymerization reaction of the polymerizable monomer and a metal compound having a vinyl group.

5 Claims, 1 Drawing Sheet

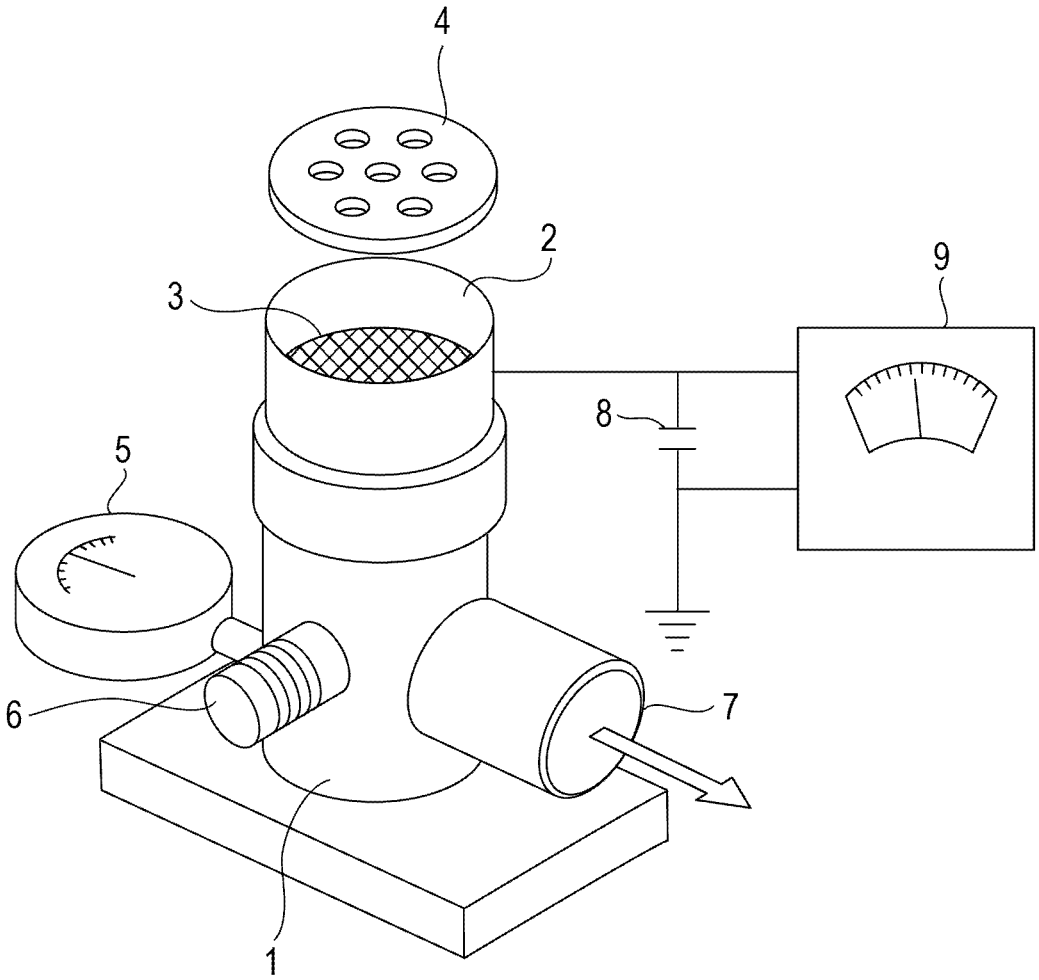
4
2
3
9
8
5
6
7
1

TONER

TECHNICAL FIELD

The present invention relates to a toner for developing an electrostatic image in an image forming method, such as electrophotographic or electrostatic printing, or a toner for forming a toner image in a toner-jet type image forming method.

BACKGROUND ART

In recent years, since printers and copying machines have been requested to have a higher process speed, higher stability, and a further reduced size, functions of components thereof have been improved. Concomitant with the above improvement in functions of the components, the number thereof is increased, and hence it is now requested to reduce the number of components. In order to obtain stable image density and hue in an electrophotographic method, it is necessary to always form predetermined development conditions in a developing process. However, if the charge amount of toner is not stable, a considerable load is applied to a system for controlling the developability such that, for example, developing bias conditions must be optimized each time, and as a result, in many cases, the size of a device is increased, and/or the manufacturing cost is increased. In order to reduce the load as described above, an improvement in stability of the charge amount of toner, and in particular, an improvement in stability of the charge amount of toner against the change in temperature and humidity have been required.

Many techniques have been proposed to improve the environmental stability of the toner charge amount. Among the techniques, controls using a charge control agent have been the mainstream technique, and for example, a toner containing a calixarene compound, a toner using an iron-containing azo dye, and a toner using an organic boron compound have been proposed (for example, see Patent Documents 1 to 4). However, the toners described above are not sufficient in terms of the toner charge amount and the charge rise characteristic of the toner with the change in temperature and humidity environment. For example, the change in image density occurs in printing, and in particular, in high temperature and high humidity environment, inconveniences, such as image fogging, caused by non-uniform charge amount distribution occur in some cases. Furthermore, in order to obtain the hue stability of image, color mixability of the toner is also important, and in particular, at a high-light portion, the transparency of the toner is required. In addition, as a colorant used for the toner, highly stable pigments have been mainly used in consideration of discoloration and the like. Various techniques for dispersing a pigment in the toner have been proposed. Among those techniques, many proposals in which a polar resin is added have been mainly made, and in more particular, polyester-based charge control agents obtained by polycondensation of monomers containing a sulfonic acid (sulfonic salt) have been proposed (for example, see Patent Documents 5 and 6). According to these proposals, it is believed that since a charge control resin is a polyester resin, the compatibility thereof with a polyester-based binder resin and the dispersibility of pigment are improved. However, in practice, the dispersibility of the pigment in the binder resin is not sufficiently improved by simply changing the composition of the charge control agent, and hence, further improvement has been desired.

CITATION LIST

Patent Literature

PTL 1 Japanese Patent Laid-Open No. 7-152207
PTL 2 Japanese Patent Laid-Open No. 8-6297
PTL 3 Japanese Patent Laid-Open No. 2002-287429
PTL 4 Japanese Patent Laid-Open No. 2004-219507
PTL 5 Japanese Patent Laid-Open No. 2003-96170
PTL 6 Japanese Patent Laid-Open No. 2003-215853

SUMMARY OF INVENTION

Technical Problem

Accordingly, the present invention provides a toner, the charge amount and the charge rise characteristic of which are unlikely to be influenced by the change in temperature and humidity environment.

Furthermore, in order to obtain an image output having excellent transparency, color mixability, and hue stability, the present invention also provides a toner excellent in pigment dispersibility.

Solution to Problem

The present invention provides a toner comprising toner particles which are produced by a process including the steps of dispersing a monomer composition containing a polymerizable monomer and a colorant in an aqueous medium to form droplets and polymerizing the polymerizable monomer in the droplets, wherein each of the toner particles contains a polymer formed by a polymerization reaction of the polymerizable monomer and a metal compound having a vinyl group, and the metal compound having a vinyl group is a compound having a structure in which a site derived from —$COOM^1$ and/or —OH of a salicylic acid portion or a salicylic acid derivative portion of an aromatic compound represented by the following formula (1) is boned to a metal.

[Chemical 1]

Formula (1)

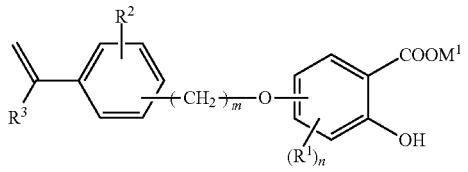

In the above formula, $R^1$ represents a hydroxyl group, a carboxyl group, an alkyl group having 1 to 18 carbon atoms, or an alkoxy group having 1 to 18 carbon atoms, $R^2$ represents a hydrogen atom, a hydroxyl group, an alkyl group having 1 to 18 carbon atoms, or an alkoxy group having 1 to 18 carbon atoms, $R^3$ represents a hydrogen atom or a methyl group, m is an integer of 1 to 3, n is an integer of 0 to 3 in which when n is 2 or 3, each $R^1$ is independently selected, and $M^1$ represents a hydrogen atom, an alkali metal, $NH_4$, or a mixture thereof.

Advantageous Effects of Invention

According to the present invention, there is provided a toner, the charge amount and the charge rise characteristic of which are unlikely to be influenced by the change in temperature and humidity environment.

In addition, according to the present invention, there is provided a toner having, besides the above effects, excellent pigment dispersibility.

BRIEF DESCRIPTION OF DRAWING

FIG. 1 is a schematic view showing the structure of a device for measuring a frictional charge amount of a two-component developer using a toner of the present invention.

DESCRIPTION OF EMBODIMENTS

The present invention provides a toner comprising toner particles which are produced by a process including the steps of dispersing a monomer composition containing a polymerizable monomer and a colorant in an aqueous medium to form droplets and polymerizing the polymerizable monomer in the droplets, wherein each of the toner particles contains a polymer formed by a polymerization reaction of the polymerizable monomer and a metal compound having a vinyl group, and the metal compound having a vinyl group is a compound having a structure in which a site derived from —$COOM^1$ and/or —OH of a salicylic acid portion or a salicylic acid derivative portion of an aromatic compound represented by the following formula (1) is boned to a metal.

[Chemical 2]

Formula (1)

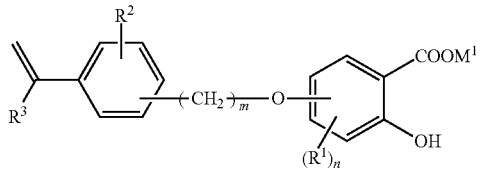

In the above formula, $R^1$ represents a hydroxyl group, a carboxyl group, an alkyl group having 1 to 18 carbon atoms, or an alkoxy group having 1 to 18 carbon atoms, $R^2$ represents a hydrogen atom, a hydroxyl group, an alkyl group having 1 to 18 carbon atoms, or an alkoxy group having 1 to 18 carbon atoms, $R^3$ represents a hydrogen atom or a methyl group, m is an integer of 1 to 3, n is an integer of 0 to 3 in which when n is 2 or 3, each $R^1$ is independently selected, and $M^1$ represents a hydrogen atom, an alkali metal, $NH_4$, or a mixture thereof.

In addition, "—$COOM^1$ and/or —OH of a salicylic acid portion or a salicylic acid derivative portion" indicates —$COOM^1$ and —OH of the following portion forming the right side of the formula (1).

[Chemical 3]

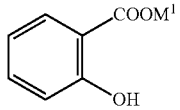

The present inventors discovered that in a toner having the structure as described above, the saturated charge amount and the charge rise characteristic to the frictional frequency are not likely to depend on temperature and humidity environment, and hence, the present invention was made.

In general, a frictional charge amount generated on the surface of the toner is liable to be influenced by an absolute water amount on the surface thereof. The reason for this is believed that since water molecules are deeply involved in transfer of charge, when a desorption frequency of water molecules on the surface of the toner is increased in a high humidity condition, a leak rate of the charge is increased, and hence a decrease in the saturated charge amount and a decrease in the charge rise rate occur. However, when a component having the structure as described above is present in the toner particle as in the case of the present invention, the charge generated on the surface of the toner by frictional charging is maintained even in high temperature and high humidity environment and is not likely to be influenced by outside temperature and humidity.

Although the reason of the above phenomenon has not been clearly understood, the present inventors have considered as described below. That is, it is considered that since a metal complex portion of the salicylic acid structure contained in the component of the compound (hereinafter also referred to as "organic compound A") represented by the above formula (1) is similar to the structure of a related charge control agent, the metal complex portion has an ability as a charge generating portion by frictional charging. It is also considered that the extension of a conjugated system of oxygen atoms, aryl groups, and the like present in the component improves the charge transfer rate with a binder resin and/or a charging member and also enhances the charge rise characteristic. On the other hand, when excessive charging (overcharging) occurs, an effect of promptly releasing the charge to prevent local overcharging can also be expected.

The most significant effect to be expected in the present invention is that because of the presence of the conjugated system extended in the molecule, a generated charge is maintained in the molecule and is very stable against the change in temperature and humidity, which are external factors. Although the mechanism thereof has not been clearly understood, the inventors believed that since the aromatic compound A of the present invention has the structure which is not likely to be influenced by water molecules, the effect described above can be obtained.

On the other hand, the dispersibility of a pigment present in the toner depends on the wettability between the pigment and a binder resin. Hence, the reason the metal compound having a vinyl group of the present invention exhibits a pigment dispersion effect is believed that when the metal compound having a vinyl group adsorbs on the pigment surface, the pigment is modified to have a surface which is likely to be wet with the binder resin. Although this adsorption mechanism has not been clearly understood, it is considered that a salicylic acid salt containing a metal or a metal complex component interacts with a polar group or a conjugated system present on the pigment surface to promote the adsorption. The present inventors believed that since the metal compound having a vinyl group of the present invention adsorbed on the pigment has an effect of suppressing aggregation between pigment particles due to its bulky molecular structure, the effect of the present invention can be obtained.

In addition, in a process, such as a polymerization reaction or drying of toner particles, in which heat is particularly applied, the pigment in the toner is liable to be re-aggregated. The metal compound having a vinyl group of the present invention adsorbed on the pigment surface is considered to form a copolymer by a polymerization reaction with a polymerizable monomer present in the vicinity of the pigment surface. The copolymer formed in the vicinity of the pigment surface is considered to exhibit a high spacer effect to the pigment particles while suppressing re-aggregation thereof in the polymerization reaction. In addition, also in a subsequent process in which heat is applied, it is believed that the copolymer suppresses re-aggregation of the pigment particles by its high spacer effect, and hence the dispersion state of the pigment is stabilized in the toner.

Hereinafter, the present invention will be described in detail.

The toner of the present invention is a toner including toner particles which are obtained by the steps of dispersing a monomer composition containing a polymerizable monomer and a colorant in an aqueous medium to form droplets and polymerizing the polymerizable monomer in the droplets, and the toner particles contain a polymer formed by a polymerization reaction of the polymerizable monomer and a metal compound having a vinyl group. In addition, the metal compound having a vinyl group is a compound formed by a reaction of a metal reagent and an aromatic compound A at salicylic acid portion or a salicylic acid derivative portion thereof, and the aromatic compound A must be a compound represented by the following formula (1).

[Chemical 4]

Formula (1)

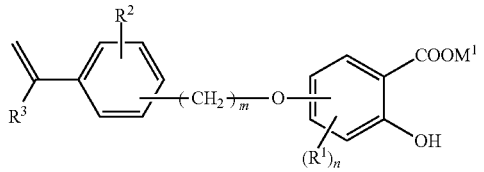

It was found that in order to obtain the effect of the present invention, the aromatic compound A must have a salicylic acid structure and must further have an aromatic ring connected thereto through an alkyl ether which is advantageous for electron conduction. The present invertors believed that a large conjugated system structure extending from the salicylic acid derivative is important and has a function as a role of maintaining electrification charge while minimizing the influence of outside temperature and humidity.

In the formula, $R^1$ represents a hydroxyl group, a carboxyl group, an alkyl group having 1 to 18 carbon atoms, or an alkoxy group having 1 to 18 carbon atoms. $R^2$ represents a hydrogen atom, a hydroxyl group, an alkyl group having 1 to 18 carbon atoms, or an alkoxy group having 1 to 18 carbon atoms. $R^3$ represents a hydrogen atom or a methyl group. m is an integer of 1 to 3, and n is an integer of 0 to 3. When n is 2 or 3, each $R^1$ is independently selected. $M^1$ represents a hydrogen atom, an alkali metal, $NH_4$, or a mixture thereof. In this case, as examples of the alkyl group, there may be mentioned a methyl group, an ethyl group, a propyl group, an iso-propyl group, a n-butyl group, a tert-butyl group, a n-pentyl, an iso-pentyl group, a hexyl group, a heptyl group, an octyl group, and the like. In addition, as examples of the alkoxy group, there may be mentioned a methoxy group, an ethoxy group, a n-propoxy group, an iso-propoxy group, a n-butoxy group, an iso-butoxy group, a tert-butoxy group, a n-pentoxy group, an iso-pentoxy group, a hexyloxy group, a heptoxy group, an oxyoctyl group, an oxy-2-ethylhexyl group, and the like. These substituents are not particularly limited, and any substituents which do not inhibit the affinity with the binder resin of the toner may be used.

The metal compound having a vinyl group of the present invention can be obtained by a reaction performed between the aromatic compound A of the above formula (1) and a metal reagent in water and/or an organic solvent (preferably in an organic solvent).

As a metal forming the metal compound having a vinyl group of the present invention, for example, the following metals may be preferably used. As a divalent metal, for example, Mg, Ca, Sr, Pb, Fe, Co, Ni, Zn, and Cu may be mentioned. Among those mentioned above, Zn, Ca, Mg, and Sr are preferable. As a trivalent metal, for example, Al, B, Cr, Fe, and Ni may be mentioned. Among those mentioned above, Al, B, Cr, and Ni are preferable. As a tetravalent metal, for example, there may be mentioned Si, Zr, and Ti may be mentioned. Among those mentioned above, Si and Zr are preferable. Among those metals mentioned above, in particular, Al and Cr, which are trivalent metals, and Zn, which is a divalent metal, are preferable.

The metal compound having a vinyl group of the present invention can be obtained in such a way that after the reaction is completed, a reaction product is dispersed in an appropriate amount of water, and a precipitate is filtrated, washed with water, and dried. Although the structure of an obtained metal compound having a vinyl group is not clearly identified, it is estimated to be a metal chloride compound or a metal complex each using the aromatic compound A as a ligand.

As examples of the organic solvent used for the above reaction, for example, there may be mentioned water soluble organic solvents, such as alcohol-based, ether-based, and glycol-based organic solvents which include methanol, ethanol, isopropyl alcohol, n-butanol, tert-butanol, ethylene glycol monomethyl ether, ethylene glycol monoethyl ether, ethylene glycol dimethyl ether (monoglyme), ethylene glycol diethyl ether, propylene glycol monomethyl ether, propylene glycol monoethyl ether, diethylene glycol dimethyl ether (diglyme), triethylene glycol dimethyl ether (triglyme), tetraethylene glycol dimethyl ether (tetraglyme), ethylene glycol, and propylene glycol; and aprotic polar solvents which include tetrahydrofuran, N,N-dimethylformamide, N,N-dimethylacetamide, N-methyl-2-pyrrolidone, and dimethyl sulfoxide.

Although the amount of this organic solvent to be used is not particularly limited, the amount thereof in a weight ratio to that of the aromatic compound A is 2 to 50 times.

As the metal reagent, any metal reagents may be used which react with a salicylic acid or a salicylic acid derivative portion of the aromatic compound to generate a meal for forming the metal compound. As preferable examples of the metal reagent, for example, there may be mentioned zinc reagents (zinc-compound forming agents), such as zinc chloride, zinc sulfate, n-propoxy zinc, and n-butoxy zinc; calcium reagents (calcium-compound forming agents), such as calcium chloride and calcium hydrogen carbonate; magnesium reagents (magnesium-compound forming agents), such as magnesium chloride, magnesium hydrogen carbonate, and magnesium carbonate; strontium reagents (strontium-compound forming agents), such as strontium hydroxide and strontium nitrate; aluminum reagents (aluminum-compound forming agents), such as aluminum chloride, aluminum sulfate, basic aluminum sulfate, aluminum acetate, basic aluminum acetate, aluminum nitrate, aluminum lactate, aluminum n-propoxide, aluminum isopropoxide, and t-butoxy aluminum; titanium reagents (titanium-compound forming agents), such as titanium chloride, titanium sulfate, n-propoxy titanium, isopropoxy titanium, and n-butoxy titanium; zirconium reagents (zirconium-compound forming agents), such as zirconium chloride, zirconium sulfate, n-propoxy zirconium, ethoxy zirconium, isopropoxy zirconium, and butoxy zirconium; chromium reagents (chromium-compound forming agents), such as chromium lactate, chromium formate, chromium sulfate, chromium chloride, and chromium nitrate; iron reagents (iron-compound forming agents), such as ferric chloride, ferric sulfate, ferrous sulfate, a ferric nitrate, and ferrous ferric chloride ($Fe_3Cl_7.xH_2O$, $Fe_3Cl_8.xH_2O$); boron reagents (boron-compound forming agents), such as boric acid, boron trichloride, trimethoxy borane, and triethoxy borane; and silicon reagents (silicon-compound forming agents), such as a silicon tetrachloride, ethoxysilane, methoxysilane, butoxysilane, and isopropoxysilane. With respect to the aromatic compound A, 0.02 to 5.0 equivalents of the metal reagent is preferably used. More preferably, 0.05 to 3.0 equivalents of the metal reagent is used.

It is estimated that the metal compound having a vinyl group obtained by the reaction between the aromatic compound A and the metal reagent as described above is represented by the following formula (2) or (3). In general, such a compound has various coordination valences and coordination numbers depending on types of metal and ligand, and it has been known that the above compound may have various coordination numbers, such as approximately 2 to 12. For example, in the case in which aluminum is the central atom, when aluminum chloride or trialkyl aluminum is used, a tetra-coordination structure is formed, and when tris(8-quinolinolato)aluminum is used, a hexa-coordination structure is formed.

Hereinafter, estimated structural formulas of the metal compound having a vinyl group of the present invention will be shown below.

That is, the metal compound having a vinyl group is estimated to be represented by the following formula (2) or (3). The metal compound having a vinyl group is not always formed from one single substance but may also be expected to be a mixture containing a plurality of coordination geometries in some cases.

In the formula (2), $R^4$ represents a hydroxyl group, a carboxyl group, an alkyl group having 1 to 18 carbon atoms, or an alkoxy group having 1 to 18 carbon atoms. $R^5$ represents a hydrogen atom, a hydroxyl group, an alkyl group having 1 to 18 carbon atoms, or an alkoxy group having 1 to 18 carbon atoms. $R^6$ represents a hydrogen atom or a methyl group. g is an integer of 1 to 3, and h is an integer of 0 to 3. When h is 2 or 3, each $R^4$ is independently selected. $M^2$ represents Mg, Ca, Sr, Pb, Fe, Co, Ni, Zn, Cu, Al, B, Cr, Si, Zr, or Ti. p is an integer of 1 to 6, r is an integer of 1 to 6, q is an integer of 1 to 4, k is 0 to 3, x is an integer of 0 to 3, y is 1 or 2, and $(T)^{y+}$ represents a cation. However, a dotted line in the structural formula represents the case in which the coordination bond is formed or the case in which the coordination bond is not formed. B (boron) is represented as a metal.

[Chemical 6]

Formula (3)

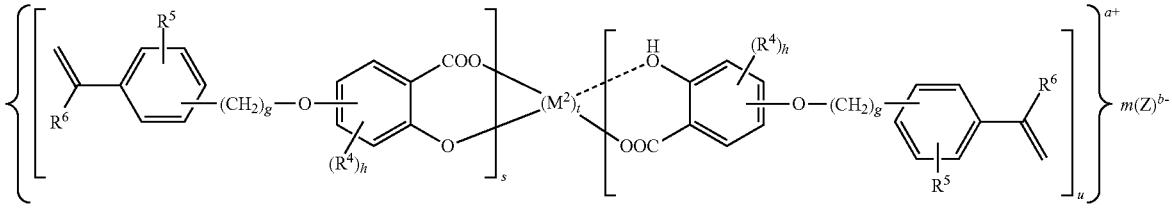

In the formula (3), $R^4$ represents a hydroxyl group, a carboxyl group, an alkyl group having 1 to 18 carbon atoms, or an alkoxy group having 1 to 18 carbon atoms. $R^5$ represents a hydrogen atom, a hydroxyl group, an alkyl group having 1 to 18 carbon atoms, or an alkoxy group having 1 to 18 carbon atoms. $R^6$ represents a hydrogen atom or a methyl group. g is an integer of 1 to 3, and h is an integer of 0 to 3. When h is 2 or 3, each $R^5$ is independently selected. $M^2$ represents Mg, Ca, Sr, Pb, Fe, Co, Ni, Zn, Cu, Al, B, Cr, Si, Zr, or Ti. s is an integer of 1 to 6, u is an integer of 1 to 6, t is an integer of 1 to 4, m is 0 to 3, a is an integer of 0 to 3, b is 1 or 2, and $(Z)^{b-}$ represents an anion. As the anion of $(Z)^{b-}$, for example, there may be mentioned anions, such as a hydroxide ion, a sulfate ion, a carbonate ion, a hydrogen carbonate ion, an acetate ion, a lactate ion, and a halogen ion. However, a dotted line in the structural formula represents the case in which the coordination bond is formed or the case in which the coordination bond is not formed. B (boron) is represented as a metal.

[Chemical 5]

Formula (2)

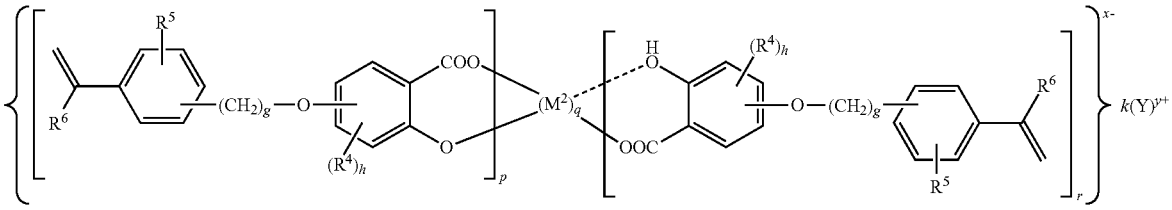

When $M^2$ represents a metal M, the formula (2) or (3) will be described in the case in which the metal M is a divalent metal, a trivalent metal, or a tetravalent metal.

When the metal M is a trivalent metal (Al, B, Cr, Fe, or Ni), an estimated structural formula is shown by the following formulas (4) to (12).

[Chemical 7]

Formula (4)

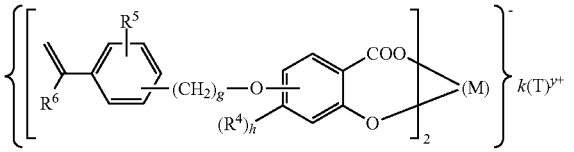

In the formula (4), $R^4$ represents a hydroxyl group, a carboxyl group, an alkyl group having 1 to 18 carbon atoms, or an alkoxy group having 1 to 18 carbon atoms. $R^5$ represents a hydrogen atom, a hydroxyl group, an alkyl group having 1 to 18 carbon atoms, or an alkoxy group having 1 to 18 carbon atoms. $R^6$ represents a hydrogen atom or a methyl group. g is an integer of 1 to 3, and h is an integer of 0 to 3. When h is 2 or 3, each $R^4$ is independently selected. k is 1 or ½, y is 1 or 2, and $(T)^{y+}$ represents a cation of a hydrogen atom, an alkali metal, or an alkaline metal, or an ammonium ion.

[Chemical 8]

Formula (5)

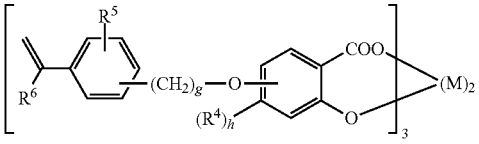

In the formula (5), $R^4$ represents a hydroxyl group, a carboxyl group, an alkyl group having 1 to 18 carbon atoms, or an alkoxy group having 1 to 18 carbon atoms. $R^5$ represents a hydrogen atom, a hydroxyl group, an alkyl group having 1 to 18 carbon atoms, or an alkoxy group having 1 to 18 carbon atoms. $R^6$ represents a hydrogen atom or a methyl group. g is an integer of 1 to 3, and h is an integer of 0 to 3. When h is 2 or 3, each $R^4$ is independently selected.

[Chemical 9]

Formula (6)

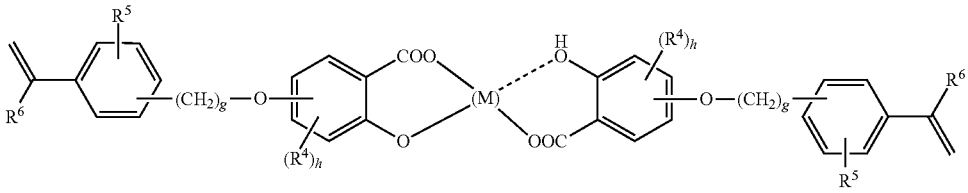

In the formula (6), $R^4$ represents a hydroxyl group, a carboxyl group, an alkyl group having 1 to 18 carbon atoms, or an alkoxy group having 1 to 18 carbon atoms. $R^5$ represents a hydrogen atom, a hydroxyl group, an alkyl group having 1 to 18 carbon atoms, or an alkoxy group having 1 to 18 carbon atoms. $R^6$ represents a hydrogen atom or a methyl group. g is an integer of 1 to 3, and h is an integer of 0 to 3. When h is 2 or 3, each $R^4$ is independently selected. However, a dotted line in the structural formula represents the case in which the coordination bond is formed or the case in which the coordination bond is not formed.

[Chemical 10]

Formula (7)

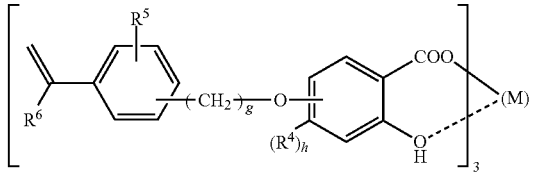

In the formula (7), $R^4$ represents a hydroxyl group, a carboxyl group, an alkyl group having 1 to 18 carbon atoms, or an alkoxy group having 1 to 18 carbon atoms. $R^5$ represents a hydrogen atom, a hydroxyl group, an alkyl group having 1 to 18 carbon atoms, or an alkoxy group having 1 to 18 carbon atoms. $R^6$ represents a hydrogen atom or a methyl group. g is an integer of 1 to 3, and h is an integer of 0 to 3. When h is 2 or 3, each $R^4$ is independently selected. However, a dotted line in the structural formula represents the case in which the coordination bond is formed or the case in which the coordination bond is not formed.

[Chemical 11]

Formula (8)

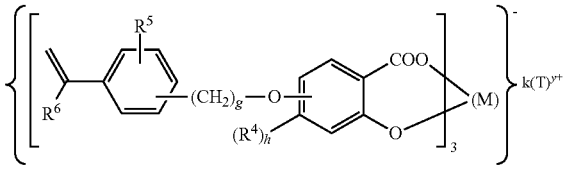

In the formula (8), $R^4$ represents a hydroxyl group, a carboxyl group, an alkyl group having 1 to 18 carbon atoms, or an alkoxy group having 1 to 18 carbon atoms. $R^5$ represents a hydrogen atom, a hydroxyl group, an alkyl group having 1 to 18 carbon atoms, or an alkoxy group having 1 to 18 carbon atoms. $R^6$ represents a hydrogen atom or a methyl group. g is an integer of 1 to 3, and h is an integer of 0 to 3. When h is 2 or 3, each $R^4$ is independently selected. k is 3 or 3/2, y is 1 or 2, and $(T)^{y+}$ represents a cation of a hydrogen atom, an alkali metal, or an alkaline metal, or an ammonium ion.

[Chemical 12]

Formula (9)

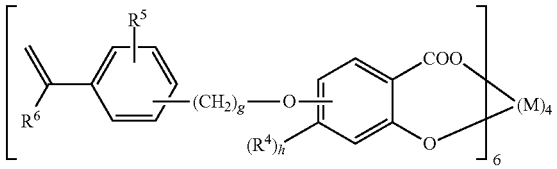

In the formula (9), $R^4$ represents a hydroxyl group, a carboxyl group, an alkyl group having 1 to 18 carbon atoms, or an alkoxy group having 1 to 18 carbon atoms. $R^5$ represents a hydrogen atom, a hydroxyl group, an alkyl group having 1 to 18 carbon atoms, or an alkoxy group having 1 to 18 carbon atoms. $R^6$ represents a hydrogen atom or a methyl group. g is an integer of 1 to 3, and h is an integer of 0 to 3. When h is 2 or 3, each $R^4$ is independently selected.

[Chemical 13]

Formula (10)

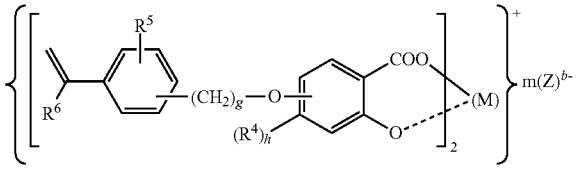

In the formula (10), $R^4$ represents a hydroxyl group, a carboxyl group, an alkyl group having 1 to 18 carbon atoms, or an alkoxy group having 1 to 18 carbon atoms. $R^5$ represents a hydrogen atom, a hydroxyl group, an alkyl group having 1 to 18 carbon atoms, or an alkoxy group having 1 to 18 carbon atoms. $R^6$ represents a hydrogen atom or a methyl group. g is an integer of 1 to 3, and h is an integer of 0 to 3. When h is 2 or 3, each $R^4$ is independently selected. m is 1 or ½, an b is 1 or 2. $(Z)^{b-}$ represents an anion of a hydroxide ion, a sulfate ion, a carbonate ion, a hydrogen carbonate ion, an acetate ion, a lactate ion, or a halogen ion.

[Chemical 14]

Formula (11)

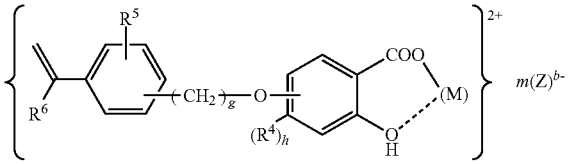

In the formula (11), $R^4$ represents a hydroxyl group, a carboxyl group, an alkyl group having 1 to 18 carbon atoms, or an alkoxy group having 1 to 18 carbon atoms. $R^5$ represents a hydrogen atom, a hydroxyl group, an alkyl group having 1 to 18 carbon atoms, or an alkoxy group having 1 to 18 carbon atoms. $R^6$ represents a hydrogen atom or a methyl group. g is an integer of 1 to 3, and h is an integer of 0 to 3. When h is 2 or 3, each $R^4$ is independently selected. m is 2 or 1, and b is 1 or 2. $(Z)^{b-}$ represents an anion of a hydroxide ion, a sulfate ion, a carbonate ion, a hydrogen carbonate ion, an acetate ion, a lactate ion, or a halogen ion.

[Chemical 15]

Formula (12)

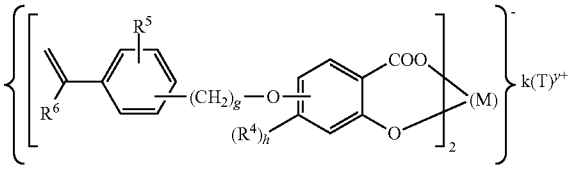

In the formula (12), $R^4$ represents a hydroxyl group, a carboxyl group, an alkyl group having 1 to 18 carbon atoms, or an alkoxy group having 1 to 18 carbon atoms. $R^5$ represents a hydrogen atom, a hydroxyl group, an alkyl group having 1 to 18 carbon atoms, or an alkoxy group having 1 to 18 carbon atoms. $R^6$ represents a hydrogen atom or a methyl group. g is an integer of 1 to 3, and h is an integer of 0 to 3. When h is 2 or 3, each $R^4$ is independently selected. k is 1 or ½, and y is 1 or 2. In addition, $(T)^{y+}$ represents a compound between a trivalent metal and the following A and is, in particular, represented by $(M(A)n)^{y+}$. In this case, A represents an anion of a hydroxide ion, a sulfate ion, a carbonate ion, a hydrogen carbonate ion, an acetate ion, a lactate ion, or a halogen ion, and n is the number of A and is 1 or 2.

When the metal M is a divalent metal (Mg, Ca, Sr, Pb, Fe, Co, Ni, Zn, or Cu), estimated structural formulas are shown by the following formulas (13) to (16).

[Chemical 16]

Formula (13)

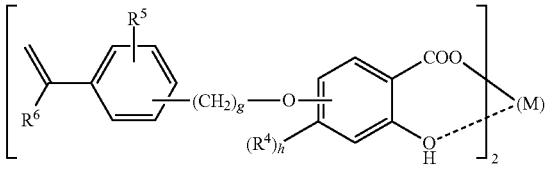

In the formula (13), $R^4$ represents a hydroxyl group, a carboxyl group, an alkyl group having 1 to 18 carbon atoms, or an alkoxy group having 1 to 18 carbon atoms. $R^5$ represents a hydrogen atom, a hydroxyl group, an alkyl group having 1 to 18 carbon atoms, or an alkoxy group having 1 to 18 carbon atoms. $R^6$ represents a hydrogen atom or a methyl group. g is an integer of 1 to 3, and h is an integer of 0 to 3. When h is 2 or 3, each $R^4$ is independently selected.

[Chemical 17]

Formula (14)

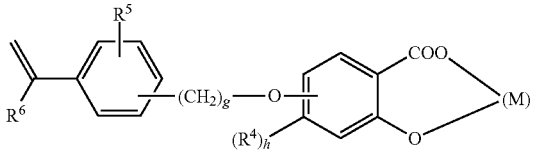

In the formula (14), $R^4$ represents a hydroxyl group, a carboxyl group, an alkyl group having 1 to 18 carbon atoms, or an alkoxy group having 1 to 18 carbon atoms. $R^5$ represents a hydrogen atom, a hydroxyl group, an alkyl group having 1 to 18 carbon atoms, or an alkoxy group having 1 to 18 carbon atoms. $R^6$ represents a hydrogen atom or a methyl group. g is an integer of 1 to 3, and h is an integer of 0 to 3. When h is 2 or 3, each $R^4$ is independently selected.

[Chemical 18]

Formula (15)

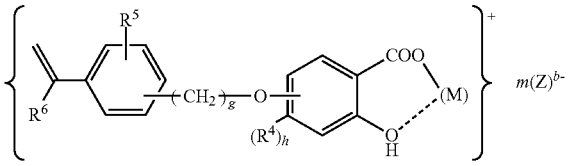

In the formula (15), $R^4$ represents a hydroxyl group, a carboxyl group, an alkyl group having 1 to 18 carbon atoms, or an alkoxy group having 1 to 18 carbon atoms. $R^5$ represents a hydrogen atom, a hydroxyl group, an alkyl group having 1 to 18 carbon atoms, or an alkoxy group having 1 to 18 carbon atoms. $R^6$ represents a hydrogen atom or a methyl group. g is an integer of 1 to 3, and h is an integer of 0 to 3. When h is 2 or 3, each $R^4$ is independently selected. m is 1 or ½, and b is 1 or 2. $(Z)^{b-}$ represents an anion of a hydroxide ion, a sulfate ion, a carbonate ion, a hydrogen carbonate ion, an acetate ion, a lactate ion, or a halogen ion.

[Chemical 19]

Formula (16)

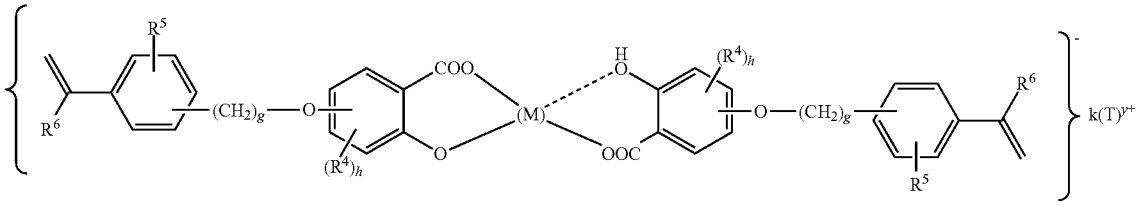

In the formula (16), $R^4$ represents a hydroxyl group, a carboxyl group, an alkyl group having 1 to 18 carbon atoms, or an alkoxy group having 1 to 18 carbon atoms. $R^5$ represents a hydrogen atom, a hydroxyl group, an alkyl group having 1 to 18 carbon atoms, or an alkoxy group having 1 to 18 carbon atoms. $R^6$ represents a hydrogen atom or a methyl group. g is an integer of 1 to 3, and h is an integer of 0 to 3. When h is 2 or 3, each $R^4$ is independently selected. k is 1, and y is 1. $(T)^{y+}$ represents a compound between a divalent metal and the following A and is, in particular, represented by $(M(A)n)^{y+}$. In this case, A represents an anion of a hydroxide ion, a sulfate ion, a carbonate ion, a hydrogen carbonate ion, an acetate ion, a lactate ion, or a halogen ion, and n is the number of A and is ½ or 1.

When the metal M is a tetravalent metal (Si, Zr, o Ti), estimated structural formulas are shown by the following formulas (17) and (18).

[Chemical 20]

Formula (17)

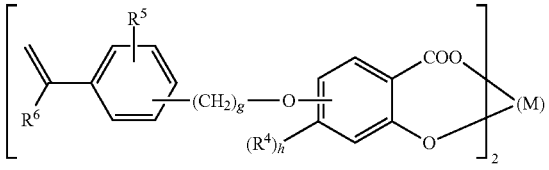

In the formula (17), $R^4$ represents a hydroxyl group, a carboxyl group, an alkyl group having 1 to 18 carbon atoms, or an alkoxy group having 1 to 18 carbon atoms. $R^5$ represents a hydrogen atom, a hydroxyl group, an alkyl group having 1 to 18 carbon atoms, or an alkoxy group having 1 to 18 carbon atoms. $R^6$ represents a hydrogen atom or a methyl group. g is an integer of 1 to 3, and h is an integer of 0 to 3. When h is 2 or 3, each $R^4$ is independently selected.

[Chemical 21]

Formula (18)

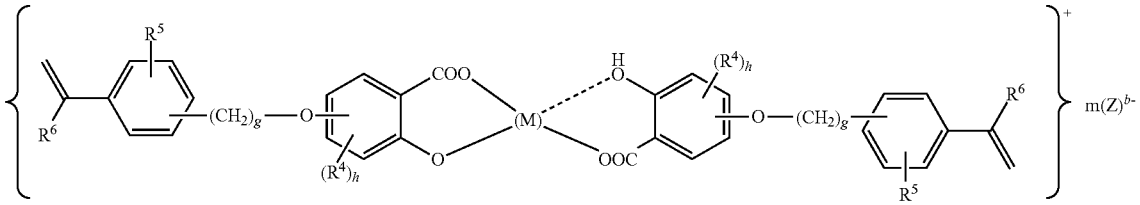

In the formula (18), $R^4$ represents a hydroxyl group, a carboxyl group, an alkyl group having 1 to 18 carbon atoms, or an alkoxy group having 1 to 18 carbon atoms. $R^5$ represents a hydrogen atom, a hydroxyl group, an alkyl group having 1 to 18 carbon atoms, or an alkoxy group having 1 to 18 carbon atoms. $R^6$ represents a hydrogen atom or a methyl group. g is an integer of 1 to 3, and h is an integer of 0 to 3. When h is 2 or 3, each $R^4$ is independently selected. m is 1 or ½, and b is 1 or 2. $(Z)^{b-}$ represents an anion of a hydroxide ion, a sulfate ion, a carbonate ion, a hydrogen carbonate ion, an acetate ion, a lactate ion, or a halogen ion.

The aromatic compound A represented by the formula (1) which can be used as a ligand of the metal compound having a vinyl group of the present invention will be described.

[Chemical 22]

Formula (1)

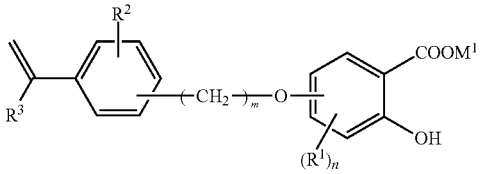

In the formula, $R^1$ represents a hydroxyl group, a carboxyl group, an alkyl group having 1 to 18 carbon atoms, or an alkoxy group having 1 to 18 carbon atoms. $R^2$ represents a hydrogen atom, a hydroxyl group, an alkyl group having 1 to 18 carbon atoms, or an alkoxy group having 1 to 18 carbon atoms. $R^3$ represents a hydrogen atom or a methyl group. n is an integer of 0 to 3. When n is 2 or 3, each $R^1$ is independently selected. $M^1$ represents a hydrogen atom, an alkali metal, $NH_4$, or a mixture thereof. In this case, as examples of the alkyl group, there may be mentioned a methyl group, an ethyl group, a propyl group, an iso-propyl group, a n-butyl group, a tert-butyl group, a n-pentyl, an iso-pentyl, a hexyl group, a heptyl group, an octyl group, and the like. In addition, as examples of the alkoxy group, there may be mentioned a methoxy group, an ethoxy group, a n-propoxy group, an iso-propoxy group, a n-butoxy group, an iso-butoxy group, a tert-butoxy group, a n-pentoxy group, an iso-pentoxy group, a hexyloxy group, a heptoxy group, an oxyoctyl group, an oxy-2-ethylhexyl group, and the like.

m is an integer of 1 to 3, and a preferable effect can be obtained when m is 1. The reason for this has not been clearly understood in detail, but the present inventors considered that when m is 0, since the benzene nucleus having a salicylic acid structure and the benzene nucleus adjacent thereto is bonded to each other only by one oxygen atom, although a conjugated system is extended to a certain extent, movement of the benzene nuclei is restricted, and hence an effect of transferring charges by an interaction with surrounding resins is not likely to be obtained.

On the other hand, when m is 4 or more, it is believed that since the distance between the above two types of benzene nuclei is increased, the transfer of charges is not likely to occur, and the effect obtained by the extension of the conjugated system is decreased.

The aromatic compound A represented by the above formula (1) can be synthesized by a known Williamson reaction method. As one example thereof, the aromatic compound A can be synthesized by a reaction between a vinylphenyl halogenated alkylene compound and a hydroxy salicylic acid compound.

When the synthesis is performed using a Williamson zreaction, as usable vinylphenyl halogenated alkylenes, for example, there may be mentioned substituted or unsubstituted vinylphenyl halogenated alkylenes, such as 4-(chloromethyl)styrene, 4-(bromomethyl)styrene, 3-methoxy-4-(chloromethyl)styrene, 3-methoxy-4-(bromomethyl)styrene, 2-hydroxy-4-(chloromethyl)styrene, 2-hydroxy-4-(bromomethyl)styrene, 2-methoxy-4-(chloromethyl)styrene, 2-methoxy-4-(bromomethyl)styrene, 3-tert-butyl-4-(chloromethyl)styrene, 3-tert-butyl-4-(bromomethyl)styrene, 3-isooctyl-4-(chloromethyl)styrene, 3-isopropyl-4-(chloromethyl)styrene, 3-methyl-4-(chloromethyl)styrene, 3-ethoxy-4-(chloromethyl)styrene, 3-carboxy-4-(chloromethyl)styrene, 3-(chloromethyl)styrene, 5-methyl-3-(chloromethyl)styrene, 5-isopropyl-3-(chloromethyl)styrene, 5-isooctyl-3-(chloromethyl)styrene, 5-methoxy-3-(chloromethyl)styrene, 4-ethoxy-3-(chloromethyl)styrene, 4-carboxy-3-(chloromethyl)styrene, 5-hydroxy-3-(chloromethyl)styrene, 4-hydroxy-3-(chloromethyl)styrene, 4-methoxy-3-(chloromethyl)styrene, 5-tert-butyl-3-(chloromethyl)styrene, 2-(chloromethyl)styrene, 3-tert-butyl-2-(chloromethyl)styrene, 4-(2-chloroethyl)styrene, 3-methoxy-4-(2-bromoethyl)styrene, 2-hydroxy-4-(2-chloroethyl)styrene, 3-ethoxy-4-(2-chloroethyl)styrene, 3-(2-chloroethyl)styrene, 5-isopropyl-3-(2-chloroethyl)styrene, 5-hydroxy-3-(2-chloroethyl)styrene, 4-hydroxy-3-(2-chloroethyl)styrene, 2-(2-chloroethyl)styrene, 4-(3-chloropropyl)styrene, 2-methoxy-4-(3-chloropropyl)styrene, 2-isopropyl-4-(3-chloropropyl)styrene, 2-isooctyl-4-(3-chloropropyl)styrene, 3-methoxy-4-(3-chloropropyl)styrene, 3-(3-chloropropyl)styrene, 5-isooctyl-3-(3-chloropropyl)styrene, 5-methoxy-3-(3-chloropropyl)styrene, and 2-(3-chloropropyl)styrene.

In addition, as particular examples of the hydroxy salicylic acid, for example, there may be mentioned 2,3-dihydroxybenzoic acid, 5-methyl-2,3-dihydroxybenzoic acid, 5-ethyl-2,3-dihydroxybenzoic acid, 5-isopropyl-2,3-dihydroxybenzoic acid, 5-n-butyl-2,3-dihydroxybenzoic acid, 5-tert-butyl-2,3-dihydroxybenzoic acid, 5-isooctyl-2,3-dihydroxybenzoic acid, 4-carboxy-2,3-dihydroxybenzoic acid, 4-methoxy-2,3-dihydroxybenzoic acid, 4-ethoxy-2,3-dihydroxybenzoic acid, 6-butoxy-2,3-dihydroxybenzoic acid, 4-hydroxy-2,3-dihydroxybenzoic acid, 6-hydroxy-2,3-dihydroxybenzoic acid, 2,4-dihydroxybenzoic acid, 6-methyl-2,4-dihydroxybenzoic acid, 6-isopropyl-2,4-dihydroxybenzoic acid, 6-tert-butyl-2,4-dihydroxybenzoic acid, 6-isooctyl-2,4-dihydroxybenzoic acid, 5-methoxy-2,4-dihydroxybenzoic acid, 5-ethoxy-2,4-dihydroxybenzoic acid, 6-butoxy-2,4-dihydroxybenzoic acid, 6-carboxy-2,4-dihydroxybenzoic acid, 5-hydroxy-6-methyl-2,4-dihydroxybenzoic acid, 2,5-dihydroxybenzoic acid, 3-methyl-2,5-dihydroxybenzoic acid, 3-isopropyl-2,5-dihydroxybenzoic acid, 3-tert-butyl-2,5-dihydroxybenzoic acid, 3-isooctyl-2,5-dihydroxybenzoic acid, 3-carboxy-2,5-dihydroxybenzoic acid, 6-methoxy-2,5-dihydroxybenzoic acid, 3-tert-butoxy-2,5-dihydroxybenzoic acid, 6-hydroxy-3-methyl-2,5-dihydroxybenzoic acid, 3,4,6-isopropyl-2,5-dihydroxybenzoic acid, 2,6-dihydroxybenzoic acid, 3-isopropyl-2,6-dihydroxybenzoic acid, 4-tert-butyl-2,6-dihydroxybenzoic acid, and 5-methyl-2,6-dihydroxybenzoic acid.

In this case, bases which can be used for the reaction are not particularly limited, and any bases which do not complicate the reaction system by a reaction with a solvent and/or a substrate may be used. For example, there may be mentioned hydroxides of alkaline metals, such as lithium hydroxide, sodium hydroxide, and potassium hydroxide, and carbonates of alkaline metals, such as lithium carbonate, sodium carbonate, and potassium carbonate.

As particular examples of a reaction solvent which can be used for the reaction, for example, there may be mentioned organic solvents, such as alcohol-based, ether-based, and glycol-based organic solvents which include methanol, ethanol, ethylene glycol monomethyl ether, ethylene glycol monoethyl ether, propylene glycol monomethyl ether, ethylene glycol dimethyl ether, diethylene glycol dimethyl ether, ethylene glycol diethyl ether, triethylene glycol dimethyl ether, tetraethylene glycol dimethyl ether, ethylene glycol, and propylene glycol; aprotic polar solvents which include N,N-dimethylformamide, N,N-dimethylacetamide, N-methyl-2-pyrrolidone, and dimethyl sulfoxide; ketones which include acetone, methyl ethyl ketone, and methyl isobutyl ketone; esters which include ethyl acetate, butyl acetate, ethyl propionate, and cellosolve acetate; hydrocarbons which include hexane, octane, petroleum ether, cyclohexane, benzene, toluene, and xylene; and halogenated hydrocarbons which include trichloroethylene, dichloromethane, and chloroform. In addition, in this reaction, in order to promote the reaction and to trap halogenated hydrogen produced as a by-product when the ether bond is formed, a base in preferably added.

Particular examples of the aromatic compound A represented by the formula (1) are shown in the following table. However, these compounds shown below are merely examples, and the aromatic compound A is not limited thereto.

TABLE 1

| AROMATIC COMPOUND A | STRUCTURAL FORMULA | $R^1$ OH, COOH, OR ALKYL OR ALKOXY EACH HAVING 1 TO 18 CARBON ATOMS | $R^2$ H, OH, COOH, OR ALKYL OR ALKOXY EACH HAVING 1 TO 18 CARBON ATOMS | $R^3$ H OR METHYL | m 1 TO 3 | n 0 TO 3 |
|---|---|---|---|---|---|---|
| M-1 | 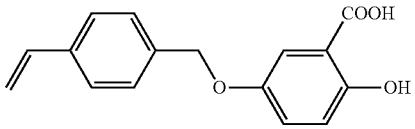 | NO SUBSTITUENT | H | H | 1 | 0 |
| M-2 | 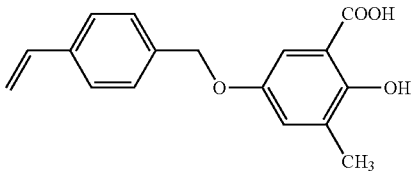 | 3-Me | H | H | 1 | 0 |
| M-3 | 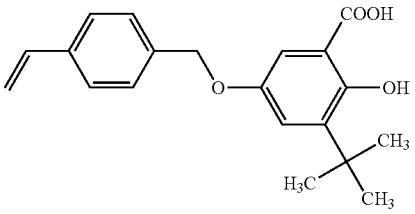 | 3-tert-Butyl | H | H | 1 | 1 |
| M-4 | 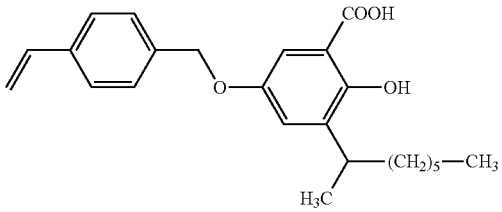 | 3-iso-Octyl | H | H | 1 | 1 |
| M-5 | 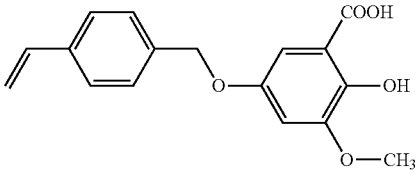 | 3-MeO | H | H | 1 | 1 |
| M-6 | 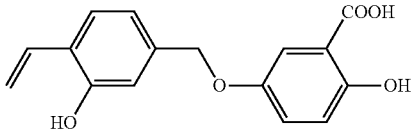 | NO SUBSTITUENT | 3-OH | H | 1 | 0 |

TABLE 1-continued

| AROMATIC COMPOUND A | STRUCTURAL FORMULA | $R^1$ OH, COOH, OR ALKYL OR ALKOXY EACH HAVING 1 TO 18 CARBON ATOMS | $R^2$ H, OH, COOH, OR ALKYL OR ALKOXY EACH HAVING 1 TO 18 CARBON ATOMS | $R^3$ H OR METHYL | m 1 TO 3 | n 0 TO 3 |
|---|---|---|---|---|---|---|
| M-7 | 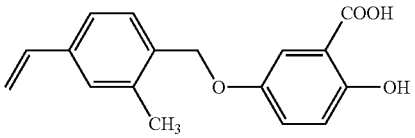 | NO SUBSTITUENT | 2-Me | H | 1 | 0 |
| M-8 | 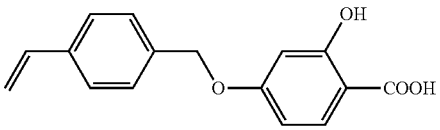 | NO SUBSTITUENT | H | H | 1 | 0 |
| M-9 | 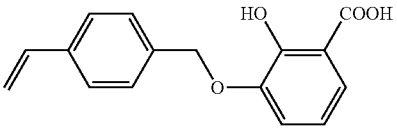 | NO SUBSTITUENT | H | H | 1 | 0 |
| M-10 | 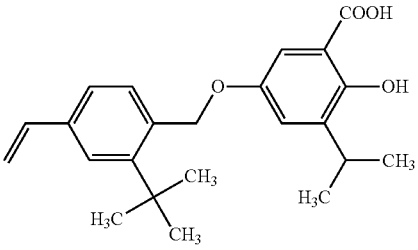 | 3-iso-Propyl | 2-tert-Butyl | H | 1 | 1 |
| M-11 | 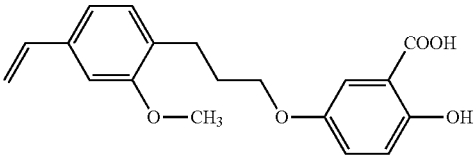 | NO SUBSTITUENT | 2-MeO | H | 3 | 0 |

The toner of the present invention can be manufactured by a suspension polymerization method including the steps of preparing a polymerizable monomer composition containing a polymerizable monomer, a colorant, and other desired components (such as a mold releasing agent and a charge control agent), dispersing the polymerizable monomer composition in an aqueous medium to form droplets, and polymerizing the polymerizable monomer in the droplets to form toner particles.

When the toner particles are manufactured by a suspension polymerization method, if being polymerized with the polymerizable monomer, the metal compound having a vinyl group can be incorporated as a binder resin together with the polymerizable monomer. In this case, a polymer derived from the metal compound having a vinyl group is estimated from its structure to have hydrophilic properties as compared to that of the other toner components (such as a mold releasing agent and a binder resin which includes no metal compound having a vinyl group). Hence, it is considered that the polymer derived from the metal compound having a vinyl group is localized in the vicinity of the surface of the toner particle. Accordingly, it is believed that the charge is likely to be generated by frictional charging. On the other hand, it is also considered that excess charge accumulated in the vicinity of the toner surface rapidly dissipates into the toner so as to suppress the toner from being excessively charged. By the mechanism described above, it is believed that the charge distribution of each toner particle is likely to have a uniform state, and that the charge rise characteristic is improved.

The metal compound having a vinyl group is polymerized into a polymer. This polymer is estimated to have the structure represented by the following formula (19) or (20).

[Chemical 23]

Formula (19)

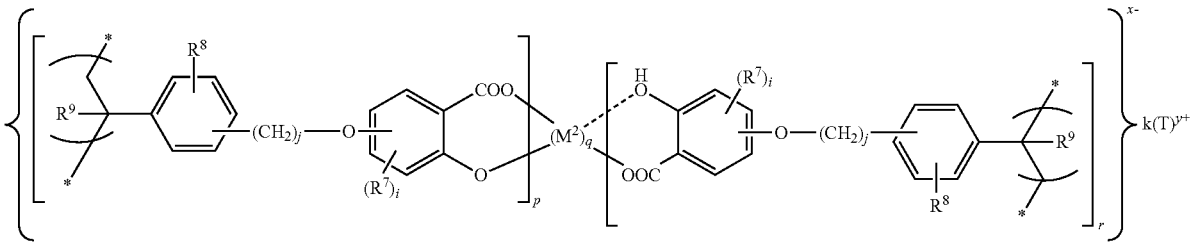

In the above formula, $R^7$ represents a hydroxyl group, a carboxyl group, an alkyl group having 1 to 18 carbon atoms, or an alkoxy group having 1 to 18 carbon atoms. $R^8$ represents a hydrogen atom, a hydroxyl group, an alkyl group having 1 to 18 carbon atoms, or an alkoxy group having 1 to 18 carbon atoms. $R^9$ represents a hydrogen atom or a methyl group. i is an integer of 0 to 3, and j is an integer of 1 to 3. When i is 2 or 3, each $R^7$ is independently selected. $M^2$ represents Mg, Ca, Sr, Pb, Fe, Co, Ni, Zn, Cu, Al, B, Cr, Si, Zr, or Ti. p is an integer of 1 to 6, r is an integer of 1 to 6, q is an integer of 1 to 4, k is 0 to 3, x is an integer of 0 to 3, an y is 1 or 2. $(T)^{y+}$ represents a cation. However, a dotted line in the structural formula represents the case in which the coordination bond is formed or the case in which the coordination bond is not formed.

[Chemical 24]

Formula (20)

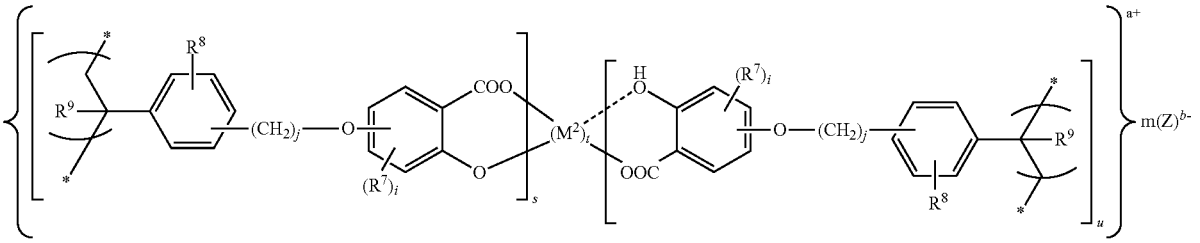

In the above formula, $R^7$ represents a hydroxyl group, a carboxyl group, an alkyl group having 1 to 18 carbon atoms, or an alkoxy group having 1 to 18 carbon atoms. $R^8$ represents a hydrogen atom, a hydroxyl group, an alkyl group having 1 to 18 carbon atoms, or an alkoxy group having 1 to 18 carbon atoms. $R^9$ represents a hydrogen atom or a methyl group. i is an integer of 0 to 3, and j is an integer of 1 to 3. When i is 2 or 3, each $R^7$ is independently selected. $M^2$ represents Mg, Ca, Sr, Pb, Fe, Co, Ni, Zn, Cu, Al, B, Cr, Si, Zr, or Ti. s is an integer of 1 to 6, u is an integer of 1 to 6, t is an integer of 1 to 4, m is 0 to 3, a is an integer of 0 to 3, and b is 1 or 2. $(Z)^{b-}$ represents a cation. As the anion of $(Z)^{b-}$, for example, an anion of a hydroxide ion, a sulfate ion, a carbonate ion, a hydrogen carbonate ion, an acetate ion, a lactate ion, or a halogen ion may be mentioned. However, a dotted line in the structural formula represents the case in which the coordination bond is formed or the case in which the coordination bond is not formed.

In the case in which the toner particles are manufactured by a suspension polymerization method, when a vinyl-based monomer is further added as a polymerizable monomer component together with the metal compound having a vinyl group, a copolymer can be obtained.

The vinyl-based monomer used in the above case is not particularly limited. In particular, for example, there may be mentioned styrene and its derivatives, such as styrene, o-methylstyrene, m-methylstyrene, p-methylstyrene, and α-methylstyrene; ethylenic unsaturated mono-olefins, such as ethylene, propylene, butylene, and isobutylene; halogenated vinyls, such as vinyl chloride, vinylidene chloride, vinyl bromide, and vinyl fluoride; vinyl esters, such as vinyl acetate, vinyl propionate, and vinyl benzoate; acrylate esters, such as n-butyl acrylate, and 2-ethylhexyl acrylate; methacrylate esters such as compounds each formed by changing the acrylate group of the above acrylate ester into a methacrylate group; amino methacrylates, such as dimethylaminoethyl methacrylate and diethylethylamino methacrylate; vinyl ethers, such as vinyl methyl ether and vinyl ethyl ether; vinyl ketones such as vinyl methyl ketone; N-vinyl compounds such as N-vinyl pyrrole; vinyl naphthalenes; acrylic acid or methacrylic acid derivatives, such as acrylonitrile, methacrylonitrile, and acrylamide; acrylic acid, and methacrylic acid. In addition, if needed, at least two types of vinyl-based monomers may be used in combination. Furthermore, a known crosslinking agent may also be added.

As a polymerization initiator which can be used when the above polymerizable monomer component is polymerized, various initiators, such as peroxide-based polymerization initiators and azo-based polymerization initiators, may be mentioned. Among the peroxide-based polymerization initiators, as organic peroxides, for example, there may be mentioned a peroxy ester, a peroxy dicarbonate, a dialkyl peroxide, a peroxy ketal, a ketone peroxide, a hydroperoxide, and a diacyl peroxide. As the inorganic peroxides, for example, there may be mentioned a persulfate and hydrogen peroxide. In particular, for example, there may be mentioned peroxy esters, such as t-butyl peroxyacetate, t-butyl peroxypivalate, t-butyl peroxyisobutyrate, t-hexyl peroxyacetate, t-hexyl peroxypivalate, t-hexyl peroxyisobutyrate, t-butyl peroxyisopropyl monocarbonate, and t-butyl peroxy 2-ethylhexyl monocarbonate; diacyl peroxides such as benzoyl peroxide; peroxy dicarbonates such as diisopropyl peroxydicarbonate; peroxy ketals such as 1,1-di(t-hexyl peroxy)cyclohexane; dialkyl peroxides such as di-t-butyl peroxide; and others such as t-butyl peroxyallyl monocarbonate. In addition, as the azo-based polymerization initiators which can be used in the present invention, for example, there may be mentioned 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobisisobutyronitrile, and dimethyl-2,2'-azobis(2-methyl propionate).

In addition, if needed, among those polymerization initiators mentioned above, at least two types thereof may be used at the same time. In this case, the amount of the polymerization initiator to be used is preferably 0.1 to 20.0 parts by mass with respect to 100 parts by mass of the polymerizable monomer.

In the present invention, the weight average molecular weight of the toner obtained by a gel permeation chromatography (GPC) is preferably in a range of 1,000 to 1,000,000. More preferably, the weight average molecular weight is in a range of 2,000 to 200,000. When the molecular weight is in the above range, contamination to members, such as a sleeve and a carrier, can be preferably suppressed.

The control of the molecular weight of the toner of the present invention can be performed when the toner is manufactured, for example, by adjusting the amounts of the metal compound having a vinyl group and the polymerizable monomer to be charged, the type and the amount of the polymerization initiator, and the reaction temperature and time.

In the present invention, when the metal derived from the metal compound having a vinyl group contained in the toner is added so that the amount thereof is 1.00 to 100 μmol with respect to 1 g of the toner, appropriate performance to maintain the charge in the toner is obtained and in addition, the effect of dispersing the pigment can also be sufficiently obtained; hence, the effect of the above metal compound is further enhanced. In addition, the content of the metal compound having a vinyl group in the toner of the present invention can be controlled by adjusting the amount thereof to be charged when the toner is manufactured.

In addition, in the present invention, all the aromatic compound A molecules are not necessarily boned to metal elements, and some molecules may be present in a non-reacted state with metals. Since an aromatic compound A which is not reacted with the metal has a charge leak (dissipation) function, the balance between the charging speed and the leaking speed is changed in accordance with the abundance ratio to the metal compound. When the reaction rate of the aromatic compound A with the metal is low, and the abundance ratio of the metal compound is low, the leaking speed becomes dominant, and hence in some cases, the charge rise characteristic is degraded, and/or the saturated charge amount is decreased.

In addition, in the present invention, when a polymer having a structure B represented by the following formula (21) is contained in the toner, an increase in saturated charge amount and an improvement in charge rise characteristic can be further effectively achieved.

[Chemical 25]

Formula (21)

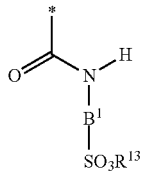

In the formula, $R^{13}$ represents a hydrogen atom or an alkyl group having 1 to 12 carbon atoms, and $B^1$ represents a substituted or unsubstituted alkylene structure having 1 or 2 carbon atoms, a substituted or unsubstituted phenylene structure, or a substituted or unsubstituted naphthylene structure. As the substituent of the alkylene structure, a hydroxyl group, an alkyl group having 1 to 12 carbon atoms, a phenyl group, a naphthyl group, or an alkoxy group having 1 to 12 carbon atoms are mentioned. As the substituent of the phenylene structure and that of the naphthylene structure, a hydroxyl group, an alkyl group having 1 to 12 carbon atoms, or an alkoxy group having 1 to 12 carbon atoms are mentioned. In this formula, * represents a bonding position to a main chain of the polymer.

In addition, $R^{13}$ in the formula (21) is more preferably a hydrogen atom or a methyl group.

Although the reason the charging properties of the toner of the present invention are improved when the polymer having the structure B represented by the formula (21) is present in the toner has not been clearly understood, the present inventors considered as described below. Because of the charge generation mechanism by a sulfonic acid group or a sulfonic acid ester group in the structure B of the formula (21) and the charge accumulation function by an amide group in the structure B, the saturated charge amount is increased, and at the same time, the charging speed is increased. On the other hand, the present inventors also believed that by the component of the present invention, excess charge accumulated by the structure B dissipates in the toner, and hence the toner is suppressed from being excessively charged. By the function described above, even if the saturated charge amount of the toner is increased, the charge distribution over the toner is likely to become uniform. It is considered that by the synergetic effect obtained from the above two phenomena, the increase in saturated charge amount and the improvement in charge rise characteristic are further achieved.

As the polymer having the structure B of the formula (21), a polymer having a vinyl structure represented by the following formula (22) may be mentioned.

[Chemical 26]

Formula (22)

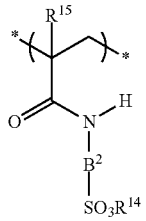

In the formula, $R^{14}$ represents a hydrogen atom or an alkyl group having 1 to 12 carbon atoms, and $R^{15}$ represents a hydrogen atom or a methyl group. $B^2$ represents a substituted or unsubstituted alkylene structure having 1 or 2 carbon atoms, a substituted or unsubstituted phenylene structure, or a substituted or unsubstituted naphthylene structure. As the substituent of the alkylene structure, a hydroxyl group, an alkyl group having 1 to 12 carbon atoms, a phenyl group, a naphthyl group, or an alkoxy group having 1 to 12 carbon atoms are mentioned. As the substituent of the phenylene structure and that of the naphthylene structure, a hydroxyl group, an alkyl group having 1 to 12 carbon atoms, or an alkoxy group having 1 to 12 carbon atoms are mentioned. In this formula, * represents a bonding position to the polymer.

A method for manufacturing the polymer is not particularly limited. When the polymer having the structure B of the formula (21) has a vinyl-based structure represented by the formula (22), a vinyl monomer represented by the following formula (23) is preferably used.

[Chemical 27]

Formula (23)

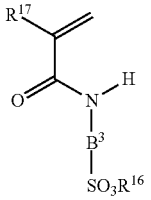

In the formula, $R^{16}$ represents a hydrogen atom or an alkyl group having 1 to 12 carbon atoms. $R^{17}$ represents a hydrogen atom or a methyl group. In this case, more preferably, $R^{16}$ represents a hydrogen atom or an alkyl group having 1 to 4 carbon atoms, and $B^3$ represents a substituted or unsubstituted alkylene structure having 1 or 2 carbon atoms, a substituted or unsubstituted phenylene structure, or a substituted or unsubstituted naphthylene structure. As the substituent of the alkylene structure, a hydroxyl group, an alkyl group having 1 to 12 carbon atoms, an aryl group, or an alkoxy group are mentioned. As the substituent of the phenylene structure and that of the naphthylene structure, a hydroxyl group, an alkyl group having 1 to 12 carbon atoms, or an alkoxy group having 1 to 12 carbon atoms are mentioned.

As particular examples of the vinyl monomer represented by the formula (23), for example, there may be mentioned 2-acrylamido-2-methylpropanesulfonic acid, 2-acrylamide benzenesulfonic acid, 2-methacrylamide benzenesulfonic acid, 3-acrylamide benzenesulfonic acid, 3-methacrylamide benzenesulfonic acid, 4-acrylamide benzenesulfonic acid, 4-methacrylamide benzenesulfonic acid, 2-acrylamide-5-methylbenzenesulfonic acid, 2-methacrylamide-5-methylbenzenesulfonic acid, 2-acrylamide-5-methoxybenzenesulfonic acid, 2-methacrylamide-5-methoxybenzenesulfonic acid, alkyl sulfonates thereof having 1 to 12 carbon atoms, and the like. In particular, among the sulfonic acid structures mentioned above by way of example, methyl sulfonate structures are more preferable.

A vinyl-based monomer which can form a copolymer with the polymer having the structure B is not specifically limited. In particular, materials similar to the vinyl-based monomers described above which can be used as the polymerizable monomer may be used.

In addition, when the polymer having the structure B is a polyester resin, various known methods may be used. For example, there may be mentioned 1) a method in which a reactive residue, such as a carboxyl group or a hydroxyl group, contained in a polyester structure is converted into the structure B of the formula (21) by an organic reaction; ii) a method in which a polyester is formed by using a polyalcohol or a polycarboxylic acid having the structure B of the formula (21) as a substituent; and iii) a method in which a functional group, which is likely to receive the structure B of the formula (21) as a substituent, is introduced in advance in a polyalcohol or a polycarboxylic acid.

In addition, in the case of a hybrid resin, for example, there may be mentioned iv) a method in which a polyester resin containing the structure B of the formula (21) as a substituent is hybridized with a vinyl monomer; v) a method in which after an acrylic resin, a methacrylic resin, or the like having a carboxyl group is polymerized as a vinyl monomer, the carboxyl group is converted into the structure B of the formula (21) by an organic reaction; and vi) a method in which a polyester resin is hybridized using a vinyl monomer having the structure B of the formula (21).

As the method in which a polyester resin is hybridized with a vinyl monomer, a known method can be used and is effective as the method iv). In particular, for example, there may be mentioned a method in which vinyl modification of a polyester is performed using a peroxide-based initiator and a method in which a polyester resin having an unsaturated group is graft-modified to form a hybrid resin.

In addition, as a particular method of the above v), for example, a method in which when the structure B of the formula (21) is introduced, a carboxyl group present in a resin is formed into an amide using a compound having an amino group at the * position of the formula (21) may be mentioned.

In addition, as a particular method of the above vi), the polymerizable monomer of the above formula (23) may be used as a usable vinyl monomer.

In the present invention, the weight average molecular weight of the polymer having the structure B of the formula (21) obtained by a gel permeation chromatography (GPC) is preferably in a range of 1,000 to 1,000,000. More preferably, the weight average molecular weight is in a range of 2,000 to 200,000. When the molecular weight of the polymer having the structure B of the formula (21) is in the above range, contamination to members, such as a sleeve and a carrier, can be preferably suppressed.

In addition, in view of the charging properties and the fixability, the molecular distribution of the polymer having the structure B of the formula (21) is preferably narrow. The ratio (Mw/Mn) of the weight average molecular weight Mw to the number average molecular weight Mn, each of which is obtained by a gel permeation chromatography, is preferably 1.0 to 6.0. In the present invention, as a method for adjusting the weight average molecular weight of the polymer having the structure B, a known method may be used.

In the case of a vinyl-based resin, the weight average molecular weight can be arbitrarily adjusted by the ratio between the amounts of the vinyl monomer of the formula (23), a vinyl-based monomer, and a polymerization initiator to be charged, the polymerization temperature, and the like.

In the case of a polyester-based resin, the weight average molecular weight can be arbitrarily adjusted by the ratio between the amounts of an acid component and an alcohol component to be charged and the polymerization time. In addition, in the case of a hybrid resin, besides the molecular weight adjustment of a polyester component, the molecular weight of a vinyl modified unit can also be adjusted. In particular, the molecular weight can be arbitrarily adjusted in a reaction process of vinyl modification by the amount of a radical polymerization initiator, the polymerization temperature, and the like. As a vinyl-based monomer which can be used for hybridization of a polyester resin in the present invention, materials similar to the above-described vinyl-based monomers which can be used as the polymerizable monomer may be used.

When the polymer having the structure B is contained in the toner of the present invention, a content b of the structure B in the toner is preferably 0.10 μmol/g or more since the effect of the present invention can be further improved. In this case, in order to adjust the content b of the structure B in the toner, the addition amount thereof may be adjusted.

A binder resin of the toner of the present invention is not particularly limited. When the toner particles are manufactured by a suspension polymerization method, by polymerization of the polymerizable monomer, the binder resin can be formed. In this case, the polymerizable monomer is not particularly limited, and the vinyl-based monomer mentioned above can be preferably used. In addition, when the toner particles are manufactured by a suspension polymerization method, if a vinyl-based resin and/or a polyester resin is further added to the monomer composition besides the polymerizable monomer, the above resin may be used as a material forming the binder resin.

As the vinyl-based resin, for example, there may be mentioned a styrene resin, an acrylic resin, a methacrylic resin, a styrene-acrylic resin, a styrene-methacrylic resin, a polyethylene resin, a polyethylene-vinyl acetate resin, a vinyl acetate resin, and a polybutadiene resin.

As the polyester resin, a polyester resin which is commonly manufactured using a polyalcohol and a carboxylic acid, a carboxylic anhydride, or a carboxylate ester as raw materials may be used. In particular, as a polyalcohol component forming the polyester resin, the following may be mentioned. As a divalent alcohol component, for example, in particular, there may be mentioned bisphenol A-alkylene oxide adducts, such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, poly(ethylene glycol), poly(propylene glycol), poly(tetramethylene glycol), bisphenol A, and hydrogenated bisphenol A.

As a trivalent alcohol component, for example, there may be mentioned sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxy methylbenzene.

As a polycarboxylic acid component, for example, there may be mentioned aromatic dicarboxylic acids, such as a phthalic acid, isophthalic acid, and terephthalic acid, or their anhydrides; alkyl dicarboxylic acids, such as succinic acid, adipic acid, sebacic acid, and azelaic acid, or their anhydrides; succinic acid substituted with an alkyl group having 6 to 12 carbon atoms or its anhydride; and unsaturated dicarboxylic acids, such as fumaric acid, maleic acid, and citraconic acid, or their anhydrides.

Among those mentioned above, in particular, a polyester resin can be preferably used which is formed by condensation polymerization using a bisphenol A derivative as the diol component and a carboxylic acid component formed of a divalent or more-valent carboxylic acid, its anhydride, or a lower alkyl ester thereof (such as fumaric acid, maleic acid, maleic anhydride, phthalic acid, terephthalic acid, trimellitic acid, and pyromellitic acid) as the acid component.

In addition, besides the vinyl-based resin and the polyester resin, a phenol resin, a polyurethane resin, a polybutyral resin, or a hybrid resin formed by using the above resins in arbitrary combination may also be used.

Among those mentioned above, the following may be preferably used in view of the toner performance. For example, there may be mentioned a styrene resin, an acrylic resin, a methacrylic resin, a styrene-acrylic resin, a styrene-methacrylic resin, a polyester resin, and a hybrid resin formed by bonding a polyester resin and a styrene-acrylic resin or a styrene-methacrylic resin.

As a colorant which can be used for the toner of the present invention, pigments having a polar group and/or a large conjugated system as that of an aromatic derivative are effectively used, and for example, known colorants which have been actually used may be mentioned.

As magenta coloring pigments, for example, there may be mentioned naphthol pigments such as C.I. Pigment Red 3; naphthol AS pigments, such as C.I. Pigments Red 5, 17, 22, 112, and 146; pyrazolone disazo pigments, such as C.I. Pigments Red 38 and 41; quinacridone pigments, such as C.I. Pigments Red 122 and 202 and C.I. Pigment Violet 19; perylene pigments, such as C.I. Pigments Red 123, 149, 178, 179, and 190; and dioxazine pigments such as C.I. Pigment Violet 23. These pigments may be used alone or may be used in combination with a dye and/or a pigment.

As cyan coloring pigments, for example, there may be mentioned C.I. Pigments Blue 15, 15:1, and 15:3 or copper phthalocyanine pigments in which a phthalocyanine skeleton is substituted with 1 to 5 phthalimidemethyl groups.

As yellow coloring pigments, for example, there may be mentioned monoazo pigments, such as C.I. Pigments Yellow 1, 3, 74, 97, and 98; disazo pigments, such as a C.I. Pigments Yellow 12, 13, 14, 17, 55, 83, and 155; condensed azo pigments, such as C.I. Pigments Yellow 93, 94, 95, and 166; isoindolinone pigments, such as C.I. Pigments Yellow 109 and 110; benzimidazolone pigments, such as C.I. Pigment Yellow 154 and 180; and isoindoline pigments, such as C.I. Pigment Yellow 185.

As black coloring pigments, for example, there may be mentioned carbon black, aniline black, acetylene black, titanium black, and a pigment prepared by using the above yellow/magenta/cyan colorants to have a black color.

In addition, the toner of the present invention may also be used as a magnetic toner, and in this case, the following magnetic materials are to be used. For example, there may be used an iron oxide, such as magnetite, maghemite, or ferrite, or an iron oxide containing another metal oxide; a metal, such as Fe, Co, or Ni, or an alloy or a mixture thereof with a metal, such as Al, Co, Cu, Pb, Mg, Ni, Sn, Zn, Sb, Ca, Mn, Se, or Ti. In more particular, there may be mentioned ferrosoferric oxide ($Fe_3O_4$), iron sesquioxide ($\gamma$-$Fe_2O_3$), zinc iron oxide ($ZnFe_2O_4$), copper iron oxide ($CuFe_2O_4$), neodymium iron oxide ($NdFe_2O_3$), barium iron oxide ($BaFe_{12}O_{19}$), magnesium iron oxide ($MgFe_2O_4$), and manganese iron oxide ($MnFe_2O_4$). The above magnetic materials may be used alone, or at least two types thereof are used in combination. In particular, as preferable magnetic materials, fine powders of ferrosoferric oxide and $\gamma$-iron sesquioxide may be mentioned.

The average particle diameter of these magnetic materials is preferably 0.1 to 1.0 μm and more preferably 0.1 to 0.3 μm. As magnetic properties at an application of 795.8 kA/m (10 Koersted), the coercive force (Hc) is 1.6 to 12 kA/m (20 to 150 oersted), and the saturated magnetization ($\sigma s$) is 5 to 200

$Am^2/kg$ and preferably 50 to 100 $Am^2/kg$. The residual magnetization (σr) is preferably 2 to 20 $Am^2/kg$.

with respect to 100 parts by mass of the binder resin, 10 to 200 parts by mass of the magnetic material may be used, and 20 to 150 parts by mass thereof is preferably used.

The toner of the present invention may also contain a mold releasing agent. As the mold releasing agent, for example, there may be mentioned aliphatic hydrocarbon waxes, such as a low molecular weight polyethylene, a low molecular weight polypropylene, a microcrystalline wax, and a paraffin wax; oxides of aliphatic hydrocarbon waxes, such as an oxide polyethylene wax; block copolymers of aliphatic hydrocarbon waxes; waxes primarily containing fatty acid esters, such as carnauba wax, sasol wax, montanic acid ester wax; partially or completely deoxidized fatty acid esters such as deoxidized carnauba wax; partially esterified compounds, such as behenic acid monoglyceride, each formed of a polyalcohol and a fatty acid; and methyl ester compounds having a hydroxyl group obtained by hydrogenation of vegetable fats and oils.

As for the molecular distribution of the mold releasing agent, the main peak is preferably in a region of a molecular weight of 400 to 2,400 and more preferably in a region of 430 to 2,000. Accordingly, preferable thermal properties can be imparted to the toner. The total addition amount of the mold releasing agent to 100 parts by mass of the binder resin is preferably 2.5 to 40.0 parts by mass and more preferably 3.0 to 15.0 parts by mass.

As a method for forming the toner particles, the above-described suspension polymerization method may be used.

When the toner particles are manufactured by a suspension polymerization method, first, the colorant is uniformly mixed in the polymerizable monomer forming the binder resin by dissolving or dispersing using a stirring machine or the like. In particular, when the colorant is a pigment, the pigment is preferably processed by a dispersing machine to form a pigment dispersion paste. The paste thus prepared is uniformly mixed with the polymerizable monomer, the metal compound having a vinyl group, the polymerization initiator, the mold releasing agent and, if needed, other additives by dissolving or dispersing using a stirring machine or the like to form the polymerizable monomer composition. In this step, the polymer having the structure B of the formula (21) can be added with the other additives to the polymerizable monomer composition. Although the effect of dispersing a pigment can be obtained when the metal compound having a vinyl group is added after the pigment dispersion paste is formed, when the metal compound having a vinyl group is mixed when the pigment dispersion paste is formed, the effect of dispersing a pigment can be further obtained. The polymerizable monomer composition thus obtained is added to a dispersion medium (preferably an aqueous medium) containing a dispersion stabilizer, and by using a high speed stirring machine as a stirring machine or a high speed dispersing machine such as a ultrasonic dispersing machine, the polymerizable monomer composition is finely dispersed to the size of the diameter of the toner particle (granulation step). Subsequently, the polymerizable monomer composition finely dispersed in the granulation step is polymerized with light or heat (polymerization step), so that the toner particles can be obtained.

In addition, in the present invention, besides the above method, after the above granulation step is performed, a suspension polymerization can also be performed by adding the metal compound having a vinyl group and, if needed, a polymerizable monomer composition containing a polymerizable monomer, a polymerization initiator, and other additives to the droplets. In this case, the addition is performed at a timing when the conversion rate of the polymerizable monomer forming the droplets is 0% to 95% and more preferably 0% to 90%. In addition, the polymerization conversion rate can be measured by a gas chromatography.

As a method for dispersing the pigment in an organic solvent, a known method may be used. For example, if needed, the metal compound having a vinyl group, the resin, a pigment dispersant, and the like are dissolved in an organic solvent, and while the mixture thus prepared is stirred, the pigment powder is gradually added thereto so as to be sufficiently dissolved or dispersed in the solvent. Furthermore, when a mechanical shearing force is applied to the mixture described above by a dispersing machine, such as a ball mill, a paint shaker, a dissolver, an attritor, a sand mill, or a high-speed mill, the pigment can be stably and finely dispersed, that is, the pigment can be dispersed in the form of uniform fine particles.

In the method for manufacturing toner particles by a suspension polymerization method, although the dispersion medium which can be used is determined in consideration of the solubility of the binder resin, the organic medium, the polymerizable monomer, the organic compound having a vinyl group, and the like to the dispersion medium, an aqueous medium is preferable. As aqueous media which can be used in the present invention, for example, there may be mentioned water; alcohols, such as methyl alcohol, ethyl alcohol, modified ethyl alcohol, isopropyl alcohol, n-butyl alcohol, isobutyl alcohol, tert-butyl alcohol, and sec-butyl alcohol; and ether alcohols, such as methyl cellosolve, cellosolve, isopropyl cellosolve, butyl cellosolve, and diethylene glycol monobutyl ether. Besides those mentioned above, as the aqueous media, for example, there may also be mentioned ketones, such as acetone, methyl ethyl ketone, and methyl isobutyl ketone; esters such as ethyl acetate; ethers, such as ethyl ether and ethylene glycol; acetals, such as methylal and diethyl acetal; and acids, such as formic acid, acetic acid, and propionic acid; however, water and alcohols are particularly preferable. In addition, among those solvents mentioned above, at least two types thereof may be used in combination. The concentration of the liquid mixture or the polymerizable monomer composition to the dispersion medium is preferably 1 to 80 parts by mass and more preferably 10 to 65 parts by mass.

As the dispersion stabilizer which can be used when the aqueous dispersion medium is used, known stabilizers can be used. In particular, for example, as inorganic compounds, there may be mentioned calcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. As organic compounds, for example, a poly(vinyl alcohol), gelatin, a methyl cellulose, a methyl hydroxypropyl cellulose, an ethyl cellulose, a sodium salt of a carboxymethylcellulose, a poly(acrylic acid) and its salt, and starch can be used by being dispersed in an aqueous phase. The concentration of the dispersion stabilizer is preferably 0.2 to 20.0 parts by mass to 100 parts by mass of the liquid mixture or the polymerizable monomer composition.

As an external additive, a flow improver may also be added to the toner particles. As the flow improver, for example, there may be mentioned fluorinated resin powders, such as a poly (vinylidene fluoride) fine powder and a polytetrafluoroethylene fine powder; silica fine powders, such as a silica fine powder obtained by a wet manufacturing method, a silica fine powder obtained by a dry manufacturing method, and processed silica fine powders processed by surface treatments on the silica fine powders described above using processing agents, such as a silane coupling agent, a titanium coupling agent, and a silicone oil; titanium oxide fine powers, alumina fine powders, processed titanium oxide fine powers, and processed alumina fine powders. The specific surface area of the flow improver measured by nitrogen absorption using a BET method is preferably 30 $m^2/g$ or more and more preferably 50 $m^2/g$ or more. With respect to 100 parts by mass of the toner particles, the amount of the flow improver is 0.01 to 8.0 parts by mass and preferably 0.1 to 4.0 parts by mass.

The weight average particle diameter (D4) of the toner is 3.0 to 15.0 μm and preferably 4.0 to 12.0 μm.

The toner of the present invention may be used as a two-component developer by being mixed with a magnetic carrier. As the magnetic carrier, for example, metal particles, such as iron having an oxidized or a non-oxidized surface, lithium, calcium, magnesium, nickel, copper, zinc, cobalt, manganese, chromium, and a rare earth element may be used, and in addition, alloy particles, oxide particles, both of which are formed form the above metals, and fine particles formed from ferrite may also be used.

In a developing method in which an alternating current bias is applied to a developing sleeve, covered carriers in which the surfaces of magnetic carrier cores are covered with a resin are preferably used. As a covering method, for example, there may be mentioned a method in which a coating liquid prepared by dissolving or suspending a covering material, such as a resin, in a solvent is adhered to the surfaces of the magnetic carrier cores and a method in which magnetic carrier cores and a covering material are mixed together in a powder state.

As the covering material of the magnetic carrier core, for example, a silicone resin, a polyester resin, a styrene resin, an acrylic resin, a polyamide, a poly(vinyl butyral), and an aminoacrylate resin may be mentioned. Those materials mentioned above may be used alone, or at least two thereof may be used in combination. The amount of the covering material to that of the carrier core particles is 0.1 to 30 percent by mass (preferably 0.5 to 20 percent by mass). The average particle diameter of the magnetic carriers is preferably 10 to 100 μm in terms of the 50% particle diameter (D50) on the volume basis and more preferably 20 to 70 μm. When a two-component developer is prepared, as the mixing ratio, the toner concentration in the developer is 2 to 15 percent by mass, and when the toner concentration is set to 4 to 13 percent by mass, a preferable result can be obtained.

Hereinafter, measurement methods of the physical properties will be described.

Measurement of Resin Molecular Weight

The molecular weight and the molecular weight distribution of the resin used in the present invention are each calculated by polystyrene conversion using a gel permeation chromatography (GPC). When the molecular weight of a resin having an acid group is measured, since a column elution rate depends on the acid amount, a sample in which the acid group is capped in advance must be prepared. For the capping, a methyl esterification is preferable, and a commercially available methyl esterification agent can be used. In particular, for example, a method using trimethylsilyl diazomethane as the agent may be mentioned.

The measurement of the molecular weight by GPC is performed as described below. A solution prepared in such a way that the above resin is added to tetrahydrofuran (TFT) and is left to stand still for 24 hours at room temperature is filtrated with a solvent-resistance membrane filter "Maeshori Disc" (manufactured by Toso Corp.) having a pore diameter of 0.2 μm to form a sample solution, and under the following conditions, the measurement is performed. In addition, the sample solution is prepared by adjusting the THF amount so as to have a resin concentration of 0.8 percent by mass. In this case, when the resin is not likely to be dissolved in THF, a basic solvent, such as dimethylformamide (DMF), may also be used.

Apparatus: HLC8120 GPC" (detector: RI) (manufactured by Tosoh Corp.)

Column: combination of seven columns, Shodex KF-801, 802, 803, 804, 805, 806, and 807 (manufactured by Showa Denko K.K.)

Eluent: tetrahydrofuran (THF)

Flow rate: 1.0 ml/min

Oven temperature: 40.0° C.

Amount of sample to be injected: 0.10 ml

In addition, in order to calculate the molecular weight of the sample, a molecular weight calibration curve prepared using the following standard polystyrene resin columns is used. In particular, the standard polystyrene resin columns are columns sold under the trade name of "TSK Standard Polystyrene F-850, F-450, F-288, F-128, F-80, F-40, F-20, F-10, F-4, F-2, F-1, A-5000, A-2500, A-1000, and A-500, manufactured by Tosoh Corp.).

Method for Measuring Acid Value of Resin

The acid value represents the weight (mg) of potassium hydroxide necessary to neutralize the acid contained in 1 g of the sample. Although the acid value of the present invention is measured in accordance with JIS K 0070-1992, in particular, the measurement is performed in accordance with the following procedure.

Titration is performed using a potassium hydroxide-ethyl alcohol solution at a concentration of 0.1 mole/l (manufactured by Kishida Chemical Co., Ltd.). The factor of the above potassium hydroxide-ethyl alcohol solution can be obtained using a potentiometric titration device (Automatic Potentiometric Titrator AT-510, manufactured by Kyoto Electronics Manufacturing Co., Ltd.). For this measurement, 100 ml of hydrochloric acid at a concentration of 0.100 mole/l is received in 250-ml tall beaker and is titrated with the potassium hydroxide-ethyl alcohol solution, and the factor is obtained from the amount of the potassium hydroxide-ethyl alcohol solution used for the neutralization. As the hydrochloric acid at a concentration of 0.100 mole/l, a solution prepared in accordance with JIS K 8001-1998 is used.

Next, conditions of the acid value measurement will be described.

Titration Device: Automatic Potentiometric Titrator (AT-510, manufactured by Kyoto Electronics Manufacturing Co., Ltd.)

Electrode: Combined Glass Electrode, Double Junction Type (manufactured by Kyoto Electronics Manufacturing Co., Ltd.)

Control Software for Titration Device: AT-WIN

Titration Analysis Software: Tview

Titration parameters and control parameters in the titration are set as shown below.

Titration Parameter

Titration Mode: Blank Titration

Titration Form: Full Titration

Maximum Titration Volume: 20 ml

Wait Time before Titration: 30 seconds

Titration Direction: Auto

Control Parameter

End Sense Potential: 30 dE

End Sense Differential: 50 dE/dmL

Setting of End Point Area: Not set

Control Speed Mode: Standard

Gain: 1
Data Sampling Potential: 4 mV
Data Sampling Titration Volume: 0.1 ml
Main Test After 0.100 g of a measurement sample is precisely measured and is placed in a 250-ml tall beaker, 150 ml of a mixed solution of toluene and ethanol (3:1) is added in the beaker, and the sample is dissolved in the mixed solution over 1 hour. By the above potentiometric titration device, titration is performed using the potassium hydroxide-ethyl alcohol solution.

Blank Test

Except that the sample is not used (that is, a mixed solution of toluene and ethanol (3:1) is only used), titration is performed in a manner similar to that of the above operation.

The obtained results are substituted in the following formula, and the acid value is calculated.

$$A=[(C-B)\times f\times 5.611]/S$$

In the formula, A represents the acid value (mgKOH/g), B represents the addition amount (ml) of the potassium hydroxide-ethyl alcohol solution in the blank test, C represents the addition amount (ml) of the potassium hydroxide-ethyl alcohol solution in the main test, f represents the factor of the potassium hydroxide solution, and S represents the weight of the sample (g).

Measurement Method of Hydroxyl Value of Resin

The hydroxyl value represents the weight (mg) of potassium hydroxide necessary to neutralize acetic acid which is bonded with a hydroxyl group when 1 g of the sample is acetylated. Although the hydroxyl value in the present invention is measured in accordance with JIS K 0070-1992, in particular, measurement is performed by the following procedure.

After 25.0 g of reagent-grade acetic anhydride is placed in a 100-ml measuring flask, pyridine is added thereto to form a solution having a total volume of 100 ml, and this solution is sufficiently shook to obtain an acetylating reagent. The acetylating reagent thus obtained is stored in a brown bottled so as not to be in contact with moisture, carbon dioxide, and the like.

By using a potassium hydroxide-ethyl alcohol solution at a concentration of 1.0 mole/l (manufactured by Kishida Chemical Co., Ltd.), titration is performed. The factor of the potassium hydroxide-ethyl alcohol solution can be obtained by a potentiometric titration device (Automatic Potentiometric Titrator AT-510, manufactured by Kyoto Electronics Manufacturing Co., Ltd.). For this measurement, 100 ml of hydrochloric acid at a concentration of 1.00 mole/l is placed in a 250-ml tall beaker and is titrated using the above potassium hydroxide solution, and the factor is obtained from the volume of the potassium hydroxide-ethyl alcohol solution used for the neutralization. The above hydrochloric acid at a concentration of 1.00 mole/l is prepared in accordance with JIS K 8001-1998.

Next, conditions of the hydroxyl value measurement will be described.

Titration Device: Automatic Potentiometric Titrator (AT-510, manufactured by Kyoto Electronics Manufacturing Co., Ltd.)
Electrode: Combined Glass Electrode, Double Junction Type (manufactured by Kyoto Electronics Manufacturing Co., Ltd.)
Control Software for Titration Device: AT-WIN
Titration Analysis Software: Tview
Titration parameters and control parameters in the titration are set as shown below.

Titration Parameter
Titration Mode: Blank Titration
Titration Form: Full Titration
Maximum Titration Volume: 80 ml
Wait Time before Titration: 30 seconds
Titration Direction Auto
Control Parameter
End Sense Potential: 30 dE
End Sense Differential: 50 dE/dmL
Setting of End Point Area: Not set
Control Speed Mode: Standard
Gain: 1
Data Sampling Potential: 4 mV
Data Sampling Titration Volume: 0.5 ml
Main Test After 2.00 g of a pulverized measurement sample is precisely measured and is placed in a 200-ml round-bottom flask, 5.00 ml of the acetylating reagent is precisely added thereto using a one-mark pipette. In this step, if the sample is not likely to be dissolved in the acetylating reagent, reagent-grade toluene is added thereto for dissolution.

A small funnel is placed at a neck of the flask, and the flask 1 cm from the bottom thereof is immersed in a glycerin bath at a temperature of 97° C. and is heated. In this step, in order to prevent an increase in temperature of the neck of the flask by receiving heat from the bath, thick paper having a hole is preferably provided at the foot of the neck of the flask.

After one hour passes, the flask is taken out of the glycerin bath and is then spontaneously cooled. After the spontaneous cooling, 1.00 ml of water is added through the funnel, and the flask is shook to hydrolyze acetic anhydride. In addition, in order to completely perform the hydrolysis, the flask is again heated in the glycerin bath for 10 minutes. After spontaneous cooling, the funnel and the wall of the flask are washed with 5.00 ml of ethyl alcohol.

After the sample thus obtained is transferred to a 250-ml tall beaker, 100 ml of a mixed solution of toluene/ethanol (3:1) is added thereto, and the sample is dissolved over 1 hour. By using the above potentiometric titration device, titration is performed using the potassium hydroxide-ethyl alcohol solution.

Blank Test

Except that the sample is not used, titration is performed in a manner similar to that of the above operation.

The obtained results are substituted in the following formula, and the hydroxyl value is calculated.

$$A=[\{(B-C)\times 28.05\times f\}/S]+D$$

In the formula, A represents the hydroxyl value (mgKOH/g), B represents the addition amount (ml) of the potassium hydroxide-ethyl alcohol solution in the blank test, C represents the addition amount (ml) of the potassium hydroxide-ethyl alcohol solution in the main test, f represents the factor of the potassium hydroxide solution, S represents the weight (g) of the sample, and D represents the acid value (mgKOH/g) of the resin.

Measurement of Content of Structure B in Polymer

For calculation of the content (μmol) of the structure B represented by the formula (21) in the resin, the element content (ppm) of sulfur contained in the polymer is measured, and the content of the structure B is calculated from the sulfur element content. In particular, the polymer is introduced in an automatic sample combustion device (device name: combustion ion chromatography system AQF-100 (device specification: Auto Boat Controller ABC type, integration of AQF-100 and GA-100, manufactured by DIA Instruments Co., Ltd.)) and is then formed into a combustion gas, and this gas is absorbed in an absorbing liquid ($H_2O_2$, aqueous solution at a concentration of 30 ppm). Next, by an ion chromatography (device name: Ion Chromatograph ICS2000, Column: ION-PACAS17, manufactured by Nippon Dionex K.K.), the amount of $SO_4$ contained in the absorbing liquid is measured, and from the result thereof, the sulfur element content (ppm) contained in the polymer is calculated. By the sulfur element content (ppm) in the polymer thus obtained, the content (μmol) of the structure B represented by the formula (21) in the polymer is calculated. In addition, the structure identification of the structure B can be performed by analysis using NMR which will be described later.

Measurement of Content of Structure B in Toner

In order to obtain the content (μmol/g) of the structure B represented by the formula (21) in 1 g of the toner, the sulfur content (ppm) contained in the toner is measured, and from this sulfur content, the content of the structure B can be calculated. The measurement can be performed in a manner similar to that of the above measurement of the sulfur element content.

Structure Analysis of Polymer and Polymerizable Monomer

The structure of the polymer having the structure B and that of the polymerizable monomer can be identified by using a nuclear magnetic resonance device ($^1$H-NMR, $^{13}$C-NMR) and an FT-IR spectrometer. Hereinafter, the devices which can be used in the present invention will be described.

(i) $^1$H-NMR, $^{13}$C-NMR

FT-NMR JNM-EX400 manufactured by JEOL Ltd. (solvent: deuterium chloroform)

(ii) FT-IR Spectrometer

AVATAR360FT-IR manufactured by Nicolet.

Quantitative Determination of Metal Amount in Metal Compound Having Vinyl Group

The amount of the metal in the metal compound having a vinyl group is quantitatively determined by a fluorescent x-ray analysis. Although the measurement of fluorescent x-ray is performed in accordance with JIS K 0119-1969, in particular, the procedure is performed as described below.

As the measuring device, a wavelength-dispersive x-ray fluorescence analyzer "Axios" (manufactured by PANalytical) and a dedicated software "SuperQ ver. 4.0F (manufactured by PANalytical) attached to the analyzer for setting measurement conditions and analyzing measurement data are used. In addition, Rh is used as an anode of an x-ray tube, a measurement environment is set to a vacuum, a measurement diameter (collimator mask diameter) is set to 27 mm, and a measurement time is set to 10 seconds. In addition, a proportional counter (PC) is used for measuring a light element, and a scintillation counter (SC) is used for measuring a heavy element.

As a measurement sample, 4 g of the polymer is placed in an aluminum ring dedicated for press purpose, and the surface of the polymer is flattened. Subsequently, a pressure of 20 MPa is applied to the polymer for 60 seconds using a tablet forming compression machine "BRE-32" (manufactured by Maekawa Testing Machine Mfg. Co., LTD.), so that a pellet having a thickness of 2 mm and a diameter of 39 mm is used.

After the measurement is performed under the conditions described above, the element is identified based on the peak position of the x-ray thus obtained, and from the count rate (unit: cps) which is the number of x-ray photons per unit time, the concentration of the element is calculated.

The quantitative determination of the metal element is performed using this measurement result and a calibration curve prepared in advance by using the metal element to be measured.

Measurement of Metal Amount in Toner

The metal amount in the toner is quantitatively determined by an induction coupled plasma spectroscopic analyzer (ICP-AES, manufactured by SII). As a pretreatment, 100.0 mg of each sample is acid-decomposed with 8.00 ml of nitric acid. Subsequently, ultrapure water is added to form a solution having a total weight of 50.00 g as a measurement sample. A calibration curve is formed from 6 points at concentrations of 0, 0.50, 1.00, 5.00, 10.00, and 20.00 ppm, and the quantitative determination of the metal amount contained in each sample is performed. In addition, after ultrapure water is added to 8.0 ml of nitric acid to form a solution having a weight of 50.00 g, the mixture thus prepared is measured as a blank, and the metal amount of the black is subtracted from the metal amount measured as described above.

Measurement Methods of Weight Average Particle Diameter (D4) and Number Average Particle Diameter (D1) of Toner The weight average particle diameter (D4) and the number average particle diameter (D1) are calculated as described below. As a measuring device, a precise particle size distribution measuring device "Coulter Counter Multisizer 3" (registered trade name, manufactured by Beckman Coulter, Inc.) equipped with an aperture tube having a diameter of 100 μm and based on a pore electrical resistance method is used. A dedicated software "Beckman Coulter Multisizer 3 Version 3.51" (manufactured by Beckman Coulter, Inc.) is used for setting measurement conditions and analyzing measurement data. In addition, the measurement is performed with 25,000 effective measurement channels.

As an electrolytic aqueous solution to be used for the measurement, a solution prepared by dissolving reagent-grade sodium chloride in ion-exchanged water to have a concentration of 1 percent by mass, such as an "ISOTON II" (manufactured by Beckman Coulter, Inc.), may be used.

In addition, the dedicated software is set as described below before measurement and analysis are performed. In the "change standard operation method (SOM)" screen of the dedicated software, the total count number of control modes is set to 50,000 particles, the number of times of measurement is set to 1, and a value obtained by using the "standard particles 10.0 μm" (manufactured by Beckman Coulter, Inc.) is set to a Kd value. A threshold and a noise level are automatically set by pressing the "threshold/noise level measurement button". In addition, the current is set to 1,600 μA, the gain is set to 2, the electrolytic solution is set to ISOTON II, and a check mark is placed in the "flush aperture tube after measurement". In the "setting for conversion from pulse to particle size" screen of the dedicated software, a bin interval is set to a logarithmic particle size, the number of particle size bins is set to 256, and the particle size range is set in a range of 2 to 60 μm.

The particular measurement method is as described below.

(1) After 200 ml of the above electrolytic solution is charged in a 250-ml round-bottom glass beaker designed exclusively for Multisizer 3. The beaker is set in a sample stand, and the electrolytic solution in the beaker is stirred with a stirring rod at 24 rotations/sec in a counterclockwise direction. Then, dirt and air bubbles in the aperture tube are removed by the "aperture flush" function of the dedicated software.

(2) Next, 30 ml of the above electrolytic solution is charged in a 100-ml flat-bottom glass beaker. Then, as a dispersant, 0.3 ml of a diluted solution prepared by diluting "Contaminon N" (an aqueous solution having a pH of 7 and a concentration of 10 percent by mass of a neutral detergent for washing a precision measuring device, containing a nonionic surfactant, a cationic surfactant, and an organic builder, manufactured by Wako Pure Chemical Industries, Ltd.) with deionized water, the mass of which is three times that of "Contaminon N".

(3) An ultrasonic disperser "Ultrasonic Dispersion System Tetora 150" (manufactured by Nikkaki Bios, Co. ltd.) is prepared in which two oscillators each having an oscillating frequency of 50 kHz are installed so that the phases thereof are shifted by 180° from each other, and each of which has an electrical output of 120 W. Next, 3.3 liters of deionized water is charged in a water tank of the ultrasonic disperser, and 2 ml of Contaminon N is added in this water tank.

(4) The beaker of the above (2) is set in a beaker fixing hole of the ultrasonic disperser, and the ultrasonic disperser is operated. Then, the height position of the beaker is adjusted so that the liquid level of the electrolytic solution in the beaker is placed in the maximum resonant state.

(5) While the electrolytic solution in the beaker of the above (4) is irradiated with ultrasonic waves, 10 mg of the toner is charged little by little to the electrolytic solution and is dispersed therein. Subsequently, the ultrasonic dispersion treatment is further continued for 60 seconds. In addition, in the ultrasonic dispersion, the temperature of the water in the water tank is appropriately adjusted in a range of 10° C. to 40° C.

(6) The electrolytic solution of the above (5) in which the toner is dispersed is dripped using a pipette in the round-bottom beaker of the above (1) set in the sample stand, and the measurement concentration is adjusted so as to be 5%. In addition, measurement is performed until 50,000 particles are measured.

(7) The measurement data is analyzed with the dedicated software attached to the device, and the weight average particle diameter (D4) and the number average particle diameter (D1) are calculated. The "average diameter" on the "analysis/volume statistics (arithmetic average)" screen obtained when the dedicated software is set to graph/volume percentage is the weight average particle diameter (D4), and the "average diameter" on the "analysis/number statistics (arithmetic average)" screen obtained when the dedicated software is set to graph/number percentage is the number average particle diameter (D1).

EXAMPLES

Hereinafter, the present invention will be described in detail with reference to examples; however, the present invention is not limited thereto. In the following examples, "part(s)" represents "part(s) by mass".

A synthetic example of the aromatic compound represented by the formula (1) will be described.

Synthetic Example of Aromatic Compound A-1

Step 1

After 100 g of 2,5-dihydroxybenzoic acid and 1,441 g of 80% sulfuric acid were mixed together while heating was performed to 50° C., 144 g of tert-butyl alcohol was added to the above mixture, and stirring was performed at 50° C. for 30 minutes. Next, an operation in which 144 g of tert-butyl alcohol was added to the mixture and stirring was performed at 50° C. for 30 minutes was performed three times. After cooled to room temperature, a reaction liquid was gradually charged in 1.00 kg of ice water, and a precipitate was filtrated. The precipitate was washed with water and was then further washed with hexane. The precipitate thus obtained was dissolved in 200 ml of methanol and was again re-precipitated in 3.60 liters of water. After filtration was performed, the precipitate thus prepared was dried at 80° C., so that 74.9 g of a salicylic acid intermediate represented by the following formula (24) was obtained.

[Chemical 28]

Formula 24

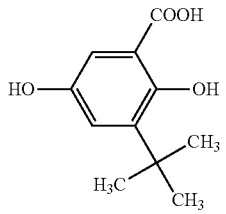

Step 2

Next, 25.0 g of the obtained salicylic acid intermediate was dissolved in 150 ml of methanol. To this solution, 36.9 g of potassium carbonate was added, and this solution was heated to 65° C. After 18.7 g of 4-(chloromethyl)styrene and 100 ml of methanol were mixed together to form a solution, and this solution was dripped to the solution containing the salicylic acid intermediate, a reaction was performed at 65° C. for 3 hours. After an obtained reaction liquid was cooled, filtration was performed, and methanol in the filtrate was distilled away at a reduced pressure, so that a residue was obtained. The residue thus obtained was dispersed in 1.50 liters of water adjusted with hydrochloric acid to have a pH of 2 and was then extracted by addition of ethyl acetate. Subsequently, after washing was performed with water, drying was performed with magnesium sulfate, and ethyl acetate was then distilled away at a reduced pressure, so that a residue was obtained. After this residue was washed with hexane, recrystallization was performed with toluene/ethyl acetate, so that 20.1 g of an aromatic compound A-1 represented by the following formula (A-1) was obtained.

[Chemical 29]

Formula (A-1)

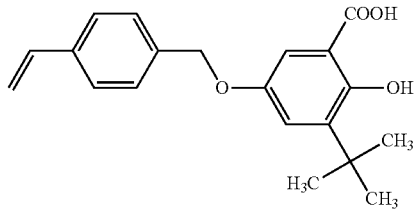

Synthetic Example of Aromatic Compound A-2

After 100.0 g of 2,5-dihydroxybenzoic acid was dissolved in 2 liters of methanol, 88.3 g of potassium carbonate was added thereto, and heating was then performed to 67° C. To this solution, 102.0 g of 4-(chloromethyl)styrene was added over 22 minutes, and a reaction was performed at 67° C. for 12 hours. An obtained reaction liquid was cooled, and methanol was distilled away at a reduced pressure, so that a residue was obtained. Hexane was added to the obtained residue for washing. After filtration was performed, the residue was dissolved in methanol and was then dripped in water for re-precipitation, so that a precipitate was obtained. The precipitate thus obtained was recovered by filtration. This re-precipitation operation was repeatedly performed twice, and the precipitate obtained thereby was dried at 80° C., so that 48.7 g of a compound A-2 having the structure represented by the following formula (A-2) was obtained.

[Chemical 30]

Formula (A-2)

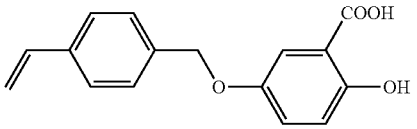

Synthesis of Aromatic Compound A-3

Except that 144 g of tert-butyl alcohol was changed to 253 g of 2-octanol, a salicylic acid intermediate was obtained by the same method as that for synthesizing the aromatic compound A-1 (Step 1). In addition, except that 32 g of the salicylic acid intermediate thus obtained was used, an aromatic compound A-3 represented by the following formula (A-3) was obtained by the same method as that for synthesizing the aromatic compound A-1 (Step 2).

[Chemical 31]

Formula (A-3)

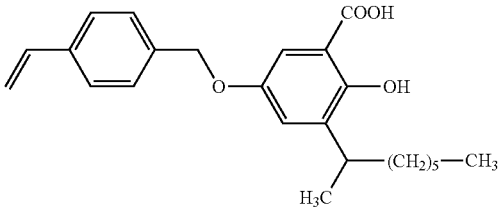

Synthetic Example of Aromatic Compound A-4

Except that the salicylic acid intermediate of the formula (24) was changed to 22 g of 2,5-dihydroxy-3-methoxybenzoic acid, an aromatic compound A-4 represented by the following formula (A-4) was obtained by the same method as that for synthesizing the aromatic compound A-1 (Step 2).

[Chemical 32]

Formula (A-4)

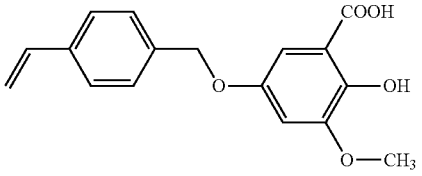

Synthetic Example of Aromatic Compound A-5

After 78.6 g of 2,4-dihydroxybenzoic acid was dissolved in 400 ml of methanol, 152.0 g of potassium carbonate was added thereto, and heating was then performed to 60° C. To this solution, 87.9 g of 4-(chloromethyl)styrene dissolved in 100 ml of methanol was dripped. After the dripping was finished, a reaction was performed at 60° C. for 2.5 hours. After a reaction liquid was cooled, a precipitate was obtained by filtration. The precipitate thus obtained was washed with methanol.

The obtained precipitate was dispersed in 1 liter of water adjusted with hydrochloric acid to have a pH of 1. A precipitate was obtained by filtration and was then washed with water. The obtained precipitate was dried at 80° C., so that 55.7 g of an aromatic compound A-5 represented by the following formula (A-5) was obtained.

[Chemical 33]

Formula (A-5)

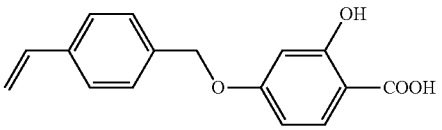

Synthetic Example of Aromatic Compound A-6

After 53.9 g of 2,3-dihydroxybenzoic acid was dissolved in 280 ml of methanol, 106 g of potassium carbonate was added thereto, and stirring was performed at 65° C. for 30 minutes. To this solution, 61.7 g of 4-(chloromethyl)styrene was dripped over 1 hour. After the dripping was finished, a reaction was performed under reflux conditions for 3 hours, and the temperature was then decreased to room temperature. Subsequently, a precipitate was filtrated, and washing was then performed with methanol. Methanol in a filtrate is removed at a reduced pressure, so that a brown semisolid was obtained. This brown semisolid was dispersed in ethyl acetate and water and was adjusted with hydrochloric acid to have a pH of 1. After an ethyl acetate layer was washed with a saturated saline solution, drying was performed with magnesium sulfate, and the solvent was removed at a reduced pressure, so that 124.3 g of a pale yellow solid was obtained. This pale yellow solid was recrystallized with toluene, so that 54.5 g of an aromatic compound A-6 represented by the following formula (A-6) was obtained.

[Chemical 34]

Formula (A-6)

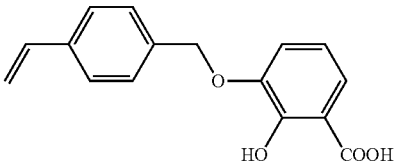

Synthetic Example of Aromatic Compound A-7

After 78.6 g of 2,4-dihydroxybenzoic acid was dissolved in 400 ml of methanol, 152.0 g of potassium carbonate was added thereto, and stirring was performed at 65° C. for 30 minutes. To this solution, 83.5 g of a mixture (trade name: "CMS-P", manufactured by AGC Seimi Chemical Co., Ltd.) of 3-(chloromethyl)styrene and 4-(chloromethyl)styrene dissolved in 50 ml of methanol was dripped over 1 hour. After a reaction was performed under reflux conditions for 3 hours, the temperature was decreased to room temperature. Subsequently, a precipitate was filtrated and was then washed with methanol. After the precipitate was added to 1 liter of water and was adjusted with hydrochloric acid to have a pH of 1, and stirring was performed for 30 minutes, followed by filtration, washing was performed with water. Drying was performed at 80° C. for 48 hours, so that 76.2 g of an aromatic compound A-7 (mixture) represented by the following formula (A-7) was obtained.

[Chemical 35]

Formula (A-7)

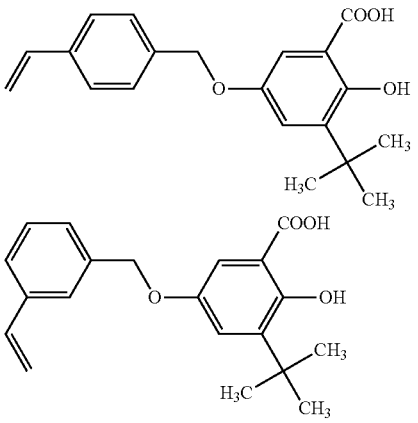

Synthetic Example of Aromatic Compound A-8

Except that 4-(chloromethyl)styrene was changed to 4-(3-chloropropyl)styrene, an aromatic compound A-8 represented by the following formula (A-8) was obtained by the same method as that for synthesizing the aromatic compound A-1 (Step 2).

[Chemical 36]

Formula (A-8)

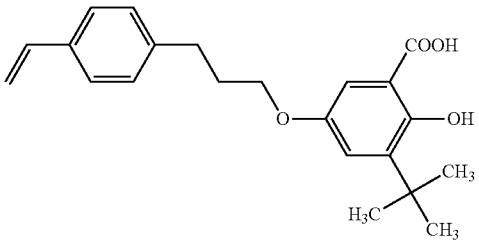

Hereinafter, synthetic examples of a metal compound having a vinyl group will be described.

Metal Compound CA-1 Having Vinyl Group

After 70.4 g of a sodium hydroxide aqueous solution at a concentration of 20% was added to 400 ml of water, 40.0 g of the aromatic compound A-1 was then added thereto, and heating was then performed to 90° C. To this solution, a solution was added for 30 minutes which was obtained in such a way that 60.0 g of an aluminum sulfate aqueous solution at a concentration of 25.7% was added to 340 ml of water and was then heated to 90° C., and heating was then performed at 95° C. for 2 hours. Next, after filtration was performed, washing was performed with water until the electrical conductivity of washing water reached 300 μS/cm or less, and drying was performed at 80° C. for 48 hours, so that 40.1 g of a metal compound CA-1 having a vinyl group was obtained.

The amount of the metal compound CA-1 having a vinyl group was quantitatively determined by a fluorescent x-ray analysis, so that the content of aluminum to the aromatic compound was quantitatively determined. The content of aluminum is shown in Table 2.

Metal Compound CA-2 Having Vinyl Group

After 16.2 g of a sodium hydroxide aqueous solution at a concentration of 20.5% was added to 130 ml of water, 10.8 g of the aromatic compound A-2 was then added thereto, and heating was then performed to 90° C. To this solution, a solution was added over 30 minutes which was obtained in such a way that 77.2 g of an aluminum sulfate aqueous solution at a concentration of 25.7% was added to 440 ml of water and was heated to 95° C., and heating was then performed at 95° C. for 2 hours. Next, after cooling was performed to room temperature, a precipitate was filtrated, and washing was performed with water until the electrical conductivity of washing water reached 300 μS/cm or less. An obtained precipitate was dried at 80° C. for 12 hours, so that 10.5 g of a metal compound CA-2 having a vinyl group was obtained. The amount of aluminum of the metal compound CA-2 having a vinyl group was quantitatively determined by a fluorescent x-ray analysis. The content of aluminum is shown in Table 2.

Metal Compound CA-3 Having Vinyl Group

Except that the aromatic compound A-1 was changed to the aromatic compound A-3, a metal compound CA-3 having a vinyl group was obtained by a method similar to that for the metal compound CA-1 having a vinyl group. The amount of aluminum of the metal compound CA-3 having a vinyl group was quantitatively determined by a fluorescent x-ray analysis. The content of aluminum is shown in Table 2.

Metal Compound CA-4 Having Vinyl Group

Except that the aromatic compound A-1 was changed to the aromatic compound A-4, a metal compound CA-4 having a vinyl group was obtained by a method similar to that for the metal compound CA-1 having a vinyl group. The amount of aluminum of the metal compound CA-3 having a vinyl group was quantitatively determined by a fluorescent x-ray analysis. The content of aluminum is shown in Table 2.

Metal Compound CA-5 Having Vinyl Group

After 90.6 g of an aluminum sulfate aqueous solution at a concentration of 25.7% was added to 519 ml of water, and heating was then performed to 95° C. To this solution, a solution was added over 25 minutes which was obtained in such a way that 73.7 g of a sodium hydroxide solution at a concentration of 20% and 50.0 g of the aromatic compound A-5 were sequentially added in this order to 500 ml of water and were then heated to 95° C., and a reaction was then performed at 95° C. for 3 hours. Next, after the reaction was completed, cooling was first performed to room temperature, a precipitate was filtrated, and washing was then performed with water until the electrical conductivity of washing water reached 300 μS/cm or less. An obtained precipitate was dried at 80° C. for 48 hours, so that 57.2 g of a metal compound CA-5 having a vinyl group was obtained. The amount of aluminum of the metal compound CA-5 having a vinyl group was quantitatively determined by a fluorescent x-ray analysis. The content of aluminum is shown in Table 2.

Metal Compound CA-6 Having Vinyl Group

Except that the aromatic compound A-2 was changed to the aromatic compound A-6, a metal compound CA-6 having a vinyl group was obtained by a method similar to that for the metal compound CA-2 having a vinyl group. The amount of aluminum of the metal compound CA-6 having a vinyl group was quantitatively determined by a fluorescent x-ray analysis. The content of aluminum is shown in Table 2.

Metal Compound CA-7 Having Vinyl Group

Except that the aromatic compound A-2 was changed to the aromatic compound A-7, a metal compound CA-7 having a vinyl group was obtained by a method similar to that for the metal compound CA-2 having a vinyl group. The amount of aluminum of the metal compound CA-7 having a vinyl group was quantitatively determined by a fluorescent x-ray analysis. The content of aluminum is shown in Table 2.

Metal Compound CA-8 Having Vinyl Group

To 400 ml of water, 70.4 g of sodium hydroxide aqueous solution at a concentration of 20% and 40.0 g of the aromatic compound A-1 were sequentially added in this order, and the mixture thus obtained was then heated to 95° C. To this solution, a solution was added over 30 minutes which was obtained in such a way that 43.0 of an aluminum sulfate aqueous solution at a concentration of 25.7% was added to 340 ml of water and was then heated to 90° C., and a reaction was then performed at 90° C. for 2 hours. Next, after the reaction was completed, cooling was first performed to room temperature, a precipitate was filtrated, and washing was then performed with water until the electrical conductivity of washing water reached 300 μS/cm or less. An obtained precipitate was dried at 80° C. for 48 hours, so that 37.2 g of a metal compound CA-8 having a vinyl group was obtained. The amount of aluminum of the metal compound CA-8 having a vinyl group was quantitatively determined by a fluorescent x-ray analysis. The content of aluminum is shown in Table 2.

Metal Compound CA-9 Having Vinyl Group

To 500 ml of water, 16.2 g of sodium hydroxide aqueous solution at a concentration of 20.5% and 10.8 g of the aromatic compound A-2 (vinyl monomer) were sequentially added in this order, and this mixture was then heated to 90° C. To this solution, 59.4 g of a zinc chloride aqueous solution at a concentration of 26.8% which was heated to 90° C. was added over 30 minutes, and a reaction was then performed at 95° C. for 2 hours. Next, after cooling was performed to room temperature, filtration was performed, and washing was performed with water until the electrical conductivity of washing water reached 300 μS/cm or less. An obtained precipitate was dried at 80° C. for 24 hours, so that 13.1 g of a metal compound CA-9 having a vinyl group was obtained. The amount of zinc of the metal compound CA-9 having a vinyl group was quantitatively determined by a fluorescent x-ray analysis. The content of zinc is shown in Table 2.

Metal Compound CA-10 Having Vinyl Group

To 500 ml of water, 16.2 g of sodium hydroxide aqueous solution at a concentration of 20.5% and 10.8 g of the aromatic compound A-2 were added, and this mixture was then heated to 90° C. To this solution, 84.9 g of a chromium sulfate aqueous solution at a concentration of 26.8% was dripped over 30 minutes, and after the temperature was increased to 95° C., a reaction was performed for 2 hours. Next, after cooling was performed to room temperature, filtration was performed, and washing was performed with water until the electrical conductivity of washing water reached 300 μS/cm or less. An obtained precipitate was dried overnight at 80° C., so that 12.9 g of a metal compound CA-10 having a vinyl group was obtained. The amount of chromium of the metal compound CA-10 having a vinyl group was quantitatively determined by a fluorescent x-ray analysis. The content of chromium is shown in Table 2.

Metal Compound CA-11 Having Vinyl Group

Except that the aromatic compound A-1 was changed to the aromatic compound A-8, a metal compound CA-11 having a vinyl group was obtained by a method similar to that for the metal compound CA-1 having a vinyl group. The amount of aluminum of the metal compound CA-11 having a vinyl group was quantitatively determined by a fluorescent x-ray analysis. The content of aluminum is shown in Table 2.

TABLE 2

| METAL | | | METAL CONTENT | |
|---|---|---|---|---|
| COMPOUND HAVING VINYL GROUP | AROMATIC COMPOUND | METAL REAGENT | TYPE OF METAL | METAL CONTENT BY FLUORESCENT X-RAY ANALYSIS (mass %) |
| CA-1 | A-1 | ALUMINUM SULFATE | Al | 5.50 |
| CA-2 | A-2 | ALUMINUM SULFATE | Al | 4.13 |
| CA-3 | A-3 | ALUMINUM SULFATE | Al | 3.33 |
| CA-4 | A-4 | ALUMINUM SULFATE | Al | 4.36 |
| CA-5 | A-5 | ALUMINUM SULFATE | Al | 5.61 |
| CA-6 | A-6 | ALUMINUM SULFATE | Al | 4.37 |
| CA-7 | A-7 | ALUMINUM SULFATE | Al | 5.39 |
| CA-8 | A-1 | ALUMINUM SULFATE | Al | 3.99 |
| CA-9 | A-2 | ZINC CHLORIDE | Zn | 14.99 |
| CA-10 | A-2 | CHROMIUM SULFATE | Cr | 11.95 |
| CA-11 | A-8 | ALUMINUM SULFATE | Al | 5.02 |

Hereinafter, synthetic examples of a polymer having the structure B will be described.

Monomer Having Structure B Represented by Formula (25)

As a monomer having the structure B, 2-acrylamide-2-methylpropanesulfonic acid represented by the formula (25) was used.

[Chemical 37]

Formula 25

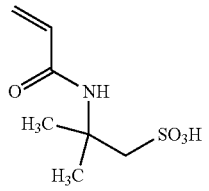

Synthetic Example of Monomer Having Structure B Represented by Formula (26)

In a reaction container equipped with a stirrer, a condenser, a thermometer, and a nitrogen introduction tube, 1,500 g of 2-acrylamide-2-methylpropanesulfonic acid, 2,060 g of trimethyl orthoformate, and 1.5 g of p-benzoquinone were charged, and a reaction was performed at 80° C. for 5 hours. Subsequently, a reaction mixture was cooled and was then vacuum-concentrated. After a precipitated crystal was filtrated, the crystal was added to 5 liters of water and was dispersed and washed. Next, the crystal was filtrated and was washed with 2.5 liters of water twice. The crystal thus obtained was processed by forward wind drying at 30° C. and was then dispersed and washed with 4 liters of hexane, followed by performing filtration. The obtained crystal was vacuum dried at 30° C., so that 1,063 g of 2-acrylamide-2-methylpropane methyl sulfonate represented by the following formula (26) was obtained.

[Chemical 38]

Formula (26)

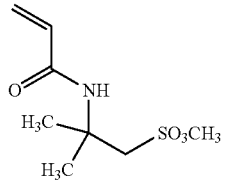

Synthetic Example of Monomer Having Structure B Represented by Formula (27)

In a reaction container equipped with a stirrer, a thermometer, and a nitrogen introduction tube, 788 g of 2-amino-5-methoxybenzenesulfonic acid, 642 g of triethylamine, and 4 liters of tetrahydrofuran were charged, and 352 g of methacrylic chloride was dripped at 5° C. or less over 15 minutes. While the mixture thus obtained was maintained at 5° C. or less, stirring was performed for 6 hours. While a reaction mixture was maintained at 5° C. or less, 800 ml of concentrated hydrochloric acid and 12.8 liters of water were further added thereto, and a liquid thus obtained was separated. After an organic layer was washed with 6.4 liters of hydrochloric acid at a concentration of 2%, washing was performed with 6.4 liters of water three times. An obtained solution was vacuum concentrated, so that a crystal was obtained. After the crystal thus obtained was charged in a reaction container equipped with a stirrer, a condenser, a thermometer, and a nitrogen introduction tube, 1,680 g of trimethyl orthoformate and 1.5 g of p-benzoquinone were charged, and a reaction was performed at 80° C. for 10 hours. A reaction mixture was cooled and was then vacuum concentrated. After a precipitated crystal was filtrated, the crystal was added to 5 liters of water and was dispersed and washed. Subsequently, the crystal was filtrated and was washed with 2.5 liters of water twice. The crystal thus obtained was processed by forward wind drying at 30° C. and was then purified using a column chromatography (5 kg of silica gel, moving phase: hexane/ethyl acetate=1/1), so that 383 g of 2-acrylamide-5-methoxybenzene methyl sulfonate represented by the following formula (27) was obtained.

[Chemical 39]

Formula (27)

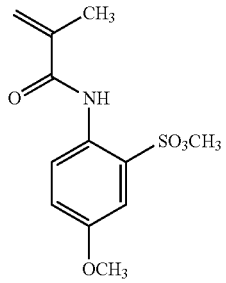

Synthetic Example of Polymer B-1

In a reaction container equipped with a stirrer, a condenser, a thermometer, and a nitrogen introduction tube, 200 parts of xylene was charged and was refluxed in a nitrogen stream.

| | |
|---|---|
| 2-acrylamide-2-methylpropanesulfonic acid | 6.00 parts |
| Styrene | 78.0 parts |
| 2-ethylhexyl acrylate | 16.0 parts |
| Dimethyl-2,2'-azobis(2-methylpropionate) | 5.00 parts |

The materials mentioned above were mixed together and were dripped in the above reaction container while being stirred, and the mixture thus obtained was maintained for 10 hours. Subsequently, distillation was performed to remove the solvent, and drying was then performed at 40° C. at a reduced pressure, so that a polymer B-1 was obtained. The sulfur atom of the polymer B-1 was quantitatively determined by an element analysis. The content of the unit (structure B) derived from the sulfonic acid in the polymer is shown in Table 3.

Synthetic Example of Polymer B-2

Except that the following materials were used, synthesis was performed in a manner similar to that of the polymer B-1, so that a polymer B-2 was obtained.

2-acrylamide-2-methylpropane methyl sulfonate 12.00 parts

Styrene 72.0 parts 2-ethylhexyl acrylate 16.0 parts

Dimethyl-2,2'-azobis(2-methylpropionate) 5.00 parts

The sulfur atom of the polymer B-2 was quantitatively determined by an element analysis. The content of the unit (structure B) derived from the methyl sulfonate in the polymer is shown in Table 3.

Synthetic Example of Polymer B-3

Except that the following materials were used, synthesis was performed in a manner similar to that of the polymer B-1, so that a polymer B-3 was obtained.

| | |
|---|---|
| 2-acrylamide-2-methylpropane methyl sulfonate | 16.00 parts |
| Styrene | 74.0 parts |
| n-butyl acrylate | 10.0 parts |
| Dimethyl-2,2'-azobis(2-methylpropionate) | 5.00 parts |

The sulfur atom of the polymer B-3 was quantitatively determined by an element analysis. The content of the unit (structure B) derived from the methyl sulfonate in the polymer is shown in Table 3.

The properties of the polymer having the structure B obtained as described above are shown in Table 3.

TABLE 3

| | PROPERTIES OF FORMED RESIN | | | |
|---|---|---|---|---|
| | S CONTENT IN POLYMER | CONTENT OF STRUCTURE B IN POLYMER | MOLECULAR WEIGHT | |
| | mass % | μ mol/g | Mw | Mn |
| POLYMER B-1 | 0.84 | 263 | 18500 | 7100 |
| POLYMER B-2 | 1.67 | 521 | 14900 | 6900 |
| POLYMER B-3 | 1.73 | 539 | 12300 | 6600 |

Hereinafter, synthetic examples of resins used for the toner of the present invention will be described.

Synthetic Example of Polyester PES-1

After the following materials were charged in a four-neck flask, and a thermometer, a stirring rod, a condenser, and a nitrogen introduction tube were fitted to the flask, a reaction was performed at 220° C. for 5 hours in a nitrogen atmosphere, so that a polyester resin PES-1 was obtained.

| | |
|---|---|
| Bisphenol-A/2.2 mole propylene oxide adduct | 67.8 parts |
| Terephthalic acid | 22.2 parts |
| Trimellitic anhydride | 10.0 parts |
| Dibutyl tin oxide | 0.005 parts |

Synthetic Example of Styrene-Acrylic Resin SA-1

In a reaction container equipped with a stirrer, a condenser, a thermometer, and a nitrogen introduction tube, 200 parts of xylene was charged and was refluxed in a nitrogen stream.

| | |
|---|---|
| Styrene | 78.0 parts |
| n-butyl acrylate | 20.0 parts |

-continued

| | |
|---|---|
| Methacrylic acid | 2.0 parts |
| Dimethyl-2,2'-azobis(2-methylpropionate) | 5.00 parts |

The materials mentioned above were mixed together and were dripped in the above reaction container while being stirred, and the mixture thus obtained was maintained for 10 hours. Subsequently, distillation was performed to remove the solvent, and drying was then performed at 40° C. at a reduced pressure, so that a styrene-acrylic resin SA-1 was obtained.

The properties of the resins thus obtained for the toner of the present invention are shown in Table 4.

TABLE 4

| | COMPOSITION OF FORMED RESIN | | | | | | | | | | |
|---|---|---|---|---|---|---|---|---|---|---|---|
| | POLYESTER RESIN COMPONENT | | | VINYL-BASED RESIN COMPONENT | | | | PROPERTIES OF FORMED RESIN | | | |
| | POLYESTER MONOMER COMPONENT (mol %) | | | VINYL-BASED RESIN MONOMER COMPONENT (mol %) | | | | | | | |
| | POLY-ALCOHOL COMPONENT | POLY-CARBOXYLIC ACID COMPONENT | CONTENT (mass %) | STYRENE | n-BA | OTHERS | CONTENT (mass %) | ACID VALUE mgKOH/g | HY-DROXYL VALUE mgKOH/g | MOLEC-ULAR WEIGHT Mw | Mn |
| PES-1 | BPA(PO) 49.9 | TPA/TMA 35.5/13.9 | 100 | — | — | — | — | 12.1 | 3.2 | 17100 | 6300 |
| SA-1 | — | — | — | 80.7 | 16.8 | MAA 2.5 | 100 | 12.0 | — | 17900 | 8100 |

Example 1

Formation of Pigment Dispersed Paste:

The following materials were sufficiently pre-mixed together in a container and were then dispersed by a bead mill for 5 hours while the temperature was maintained at 20° C. or less, so that a pigment dispersed paste was formed.

Content Ratio

| | |
|---|---|
| Styrene | 80.0 parts |
| C.I. Pigment Blue 15:3 | 14.0 parts |
| Compound CA-1 | 1.00 part |

Formation of Toner Particles

After 390 parts of a $Na_3PO_4$ aqueous solution at a concentration of 0.1 mole/l was charged to 1,150 parts of ion exchanged water and was then heated to 60° C., by using Clearmix (manufactured by M-Technique Co., Ltd.), stirring was performed at 11,000 rpm. To this mixture, 58 parts of a $CaCl_2$ aqueous solution at a concentration of 1.0 mole/l was added, so that a dispersion containing $Ca_3(PO_4)_2$ was obtained.

The following materials were heated to 60° C. and were then melted and dispersed to form a monomer mixture. Furthermore, while this mixture was maintained at 60° C., 5.00 parts of 2,2'-azobis(2,4-dimethylvaleronitrile) was added thereto as a polymerization initiator and was then dissolved, so that a monomer composition was obtained.

Content Ratio

| | |
|---|---|
| The above pigment dispersed past | 38.0 parts |
| (In the above pigment dispersed paste, 0.400 parts of the compound CA-1 was contained.) | |

-continued

| | |
|---|---|
| Styrene | 34.0 parts |
| n-butyl acrylate | 15.0 parts |
| Paraffin wax (HNP-7, manufactured by Nippon Seiro Co., Ltd. | 8.00 parts |
| Polyester PES-1 | 5.00 parts |
| Polymer B-1 | 0.600 parts |

After the above monomer composition was charged in the dispersion medium described above and was placed in a nitrogen atmosphere at 60° C., stirring was performed at 10,000 rpm for 20 minutes using Clearmix, so that the monomer composition was granulated. Subsequently, after a reaction was performed at 60° C. for 5 hours while stirring was performed by a paddle stirring blade, stirring was performed at 80° C. for 5 hours, so that the polymerization was completed. After cooling was performed to room temperature, and $Ca_3(PO_4)_2$ was dissolved by addition of hydrochloric acid, filtration, water washing, and drying were performed, so that toner particles were obtained. Furthermore, the toner particles were sieved, and toner particles having a size of 2 to less than 10 μm were selected, so that toner particles 1 were obtained.

Next, to 100 parts of the toner particles, 1.00 part of hydrophobic silica fine powder having a BET surface area of 200 $m^2/g$ was externally added by a Henschel mixer, so that a toner 1 was obtained. The properties of the toner 1 are shown in Table 5. In addition, the following evaluations were performed on the toner. The evaluation results are shown in Table 6.

Evaluation of Toner Charge Amount

A two-component developer was formed as described below.

In order to evaluate the charge amount, sample preparation was performed as described below. After 288 g of magnetic carrier F813-300 (manufactured by Powdertech Co., Ltd.) and 12 g of a toner to be evaluated were charged in a 500-cc plastic bottle equipped with a lid, and shaking was performed at a speed of 4 reciprocations per second for 1 minute by a shaker (YS-LD, manufactured by Yayoi Co., Ltd.).

The toner and the two-component developer were evaluated as described below.

Evaluation of Toner Charge Amount in High Temperature and High Humidity Environment For measurement of the charge amount, 30 g of the two-component developer was sampled and was left to stand still for full 3 days in high temperature and high humidity environment (30° C./80%). Subsequently, after the developer was received in an insulating plastic container having a volume of 50 ml and was shook 500 times at a speed of 200 times/min, measurement was performed using a device shown in FIG. 1. The absolute value of the measured charge amount was evaluated in accordance with the following criteria.

Rank A: 60.0 mC/kg or more
Rank B: 45.0 mC/kg to less than 60.0 mC/kg
Rank C: 30.0 mC/kg to less than 45.0 mC/kg
Rank D: 15.0 mC/kg to less than 30.0 mC/kg
Rank E: less than 15.0 mC/kg Measurement Method of Charge Amount In a metal measurement container 2 having a 500-mesh screen 3 (opening: 25 μm) at the bottom, 0.500 g of a two-component developer, the frictional charge amount of which was to be measured, was charged, and a metal lid 4 is fitted to the metal measurement container 2. In this measurement, the total mass of the measurement container 2 was measured and was represented by W1 (g). Next, suction was performed through a suction port 7 using a suction device 1 (part of which in contact with the measurement container 2 was at least formed of an insulating material) by adjusting a flow rate control valve 6 so that the pressure of a vacuum meter 5 was 250 mmAq. In the state as described above, in order to remove the toner by suction, suction was sufficiently performed or preferably performed for 2 minutes.

The potential of an electrometer 9 at this stage was represented by V (volts). In addition, reference numeral 8 represents a capacitor, and the capacity thereof is represented by C (μF). The total mass of the measurement container 2 after the suction was measured and was represented by W2 (g). The frictional charge amount of the toner in thins case was calculated by the following formula.

$$\text{Frictional charge amount (mC/kg)} = (C \times V)/(W1 - W2)$$

Evaluation of Environmental Dependence of Toner Charge Amount

Except that the two-component developer was left to stand still in a low temperature and low humidity environment (15° C./10%), the toner charge amount was measured by a method similar to that described for evaluation of the toner charge amount in the high temperature and high humidity environment. For the evaluation, the absolute value of the ratio of the change amount in low temperature and low humidity environment to that in high temperature and high humidity environment (charge amount in low temperature and low humidity environment/charge amount in high temperature and high humidity environment) was calculated, and evaluation was performed in accordance with the following criteria.

Rank A: less than 1.30
Rank B: 1.30 to less than 1.50
Rank C: 1.50 to less than 2.00
Rank D: 2.00 or more Evaluation of Toner Charge Rise Characteristic A two-component developer was formed as described below.

After 270 g of the magnetic carrier F813-300 (manufactured by Powdertech Co., Ltd.) and 30 g of a toner to be evaluated were charged in a 500-cc plastic bottle equipped with a lid, shaking was performed for 1 minute at a speed of 200 times/min by a shaker (YS-LD, manufactured by Yayoi Co., Ltd.). Next, 300 g of the two-component developer was left to stand still for full 3 days in high temperature and high humidity environment (30° C./80%). This two-component developer was charged in a developing unit of a cooler laser copying machine CLC5500 (manufactured by CANON KABUSHIKI KAISHA), and air rotation was performed at 240 rpm using a blank rotator equipped with an external motor. The two-component developer on a developing sleeve was sampled when rotation was performed for 1 minute (Q1min), further for 1 minute (that is, rotation for total 2 minutes), and still further for 3 minutes (Q5 min) (that is, rotation for total 5 minutes), and the charge amounts thereof were measured using the device shown in FIG. 1. After (Q5 min/Q1min) and (Q5 min/Q2 min) were calculated, evaluation was performed in accordance with the following criteria.

Rank A: less than 1.20
Rank B: 1.20 to less than 1.40
Rank C: 1.40 to less than 1.60
Rank D: 1.60 to less than 1.80
Rank E: 1.80 or more Evaluation of Change in Charge Amount by Storage in High Temperature and High Humidity Environment After 0.60 g of a toner to be evaluated was weighed and charged in a 50-ml insulating plastic container, the container was stored for 3 days in high temperature and high humidity environment (50° C./95% RH). After this container was then stored for 3 days in ordinary temperature and ordinary humidity environment (23° C./55% RH), the toner was mixed with 29.40 g of the magnetic carrier F813-300 (manufactured by Powdertech Co., Ltd.) and was then shook for 1 minute at a speed of 200 times/min using a shaker (YS-LD: manufactured by Yayoi Co., Ltd.).

In a manner similar to that described above, after 0.60 g of the toner to be evaluated was weighed and charged in a 50-ml insulating plastic container, this container was stored for 3 days in ordinary temperature and ordinary humidity environment without stored in high temperature and high humidity environment, and this toner was mixed with 29.4 g of the magnetic carrier and was shook as in the case described above.

After the charge amount of each charge evaluation sample thus formed was measured using the device shown in FIG. 1, the ratio in charge amount of the sample which was stored in high temperature and high humidity environment to the sample which was not stored therein was calculated, and storage stability was evaluated in accordance with the following criteria.

Rank A: 0.85 or more

Rank B: 0.80 to less than 0.85

Rank C: 0.70 to less than 0.80

Rank D: less than 0.70

Evaluation of Pigment Dispersibility

In order to evaluate the pigment dispersibility of the toner thus formed, an ultrathin section of the toner was formed using a microtome and was then observed by a transmission electron microscope (TEM). If needed, the section was dyed, for example, with ruthenium oxide or osmic acid. Although the evaluation criteria was changed depending on the type of pigment, in accordance with the following criteria, evaluation was performed by observation whether or not the pigment was dispersed as particles having a primary particle diameter and whether or not the pigment was unevenly distributed or came out on a surface layer of the toner.

Rank A: Pigment is dispersed as particles having a primary particle diameter and is uniformly distributed over the whole toner.

Rank B: Pigment is partially aggregated and is unevenly distributed.

Rank C: Pigment is aggregated, and many pigment particles are observed on the toner surface.

Evaluation of Reproducibility of Halftone

For the evaluation, the above two-component developer and a color copying machine CLC5500 (manufactured by CANON KABUSHIKI KAISHA) were used. The toner amount provided on paper (color laser copia paper TKCLA4, manufactured by CANON KABUSHIKI KAISHA) was changed to have 7 levels, and respective fixed images were formed. The toner amounts on the paper were 0.10 mg/cm$^2$, 0.20 mg/cm$^2$, 0.30 mg/cm$^2$, 0.40 mg/cm$^2$, 0.50 mg/cm$^2$, 0.60 mg/cm$^2$, and 0.70 mg/cm$^2$.

Evaluation of Color Toner

The CIE a* and b* of each fixed image of color toner was measured using Spectroscan manufactured by Gretag Macbeth (measurement conditions: D65, field angle: 2°). The relationship between C* and L* was obtained by plotting the chromaticity for each of the 7 level toner amounts and drawing a smooth curve passing through the above points. Based on this relationship, the value of C* at which L*=70 and the value of L* at which C*=50 were obtained. In addition, the value of C* is obtained by $C^*=((a^*)^2+(b^*)^2)^{1/2}$.

Rank A: The value of C* is 35.0 or more when L*=70, and the value of L* is 65.0 or more when C*=50 (image chroma is excellent).

Rank B: The value of C* is 30.0 or more when L*=70, and the value of L* is 60.0 or more when C*=50 (although color reproducibility is narrowed, image is good).

Rank C: The value of C* is less than 30.0 when L*=70, or the value of L* is less than 60.0 when C*=50 (poor color reproducibility).

Evaluation of Black Toner

A fixed image similar to that of the color toner was formed as described above. For each fixed image of the black toner, the image density was measured using a Macbeth reflection densitometer (manufactured by Macbeth).

Evaluation Criteria of Black Toner

Evaluation was performed as described below using the ratio of the difference (D0.4−D0.3) in image density between a toner amount of 0.30 mg/cm$^2$ and a toner amount of 0.40 mg/cm$^2$ to an image density (D0.7) at a toner amount of 0.7 mg/cm$^2$.

Rank A: (D0.4−D0.3)/(D0.7)<1.10

Rank B: 1.10(D0.4−D0.3)/(D0.7)<1.25

Rank C: 1.25(D0.4−D0.3)/(D0.7)

Example 2

Except that 1.00 part of the compound CA-2 was used instead of the compound CA-1 in the formation of the pigment dispersed paste of Example 1, a toner 2 was formed in a manner similar to that of Example 1. The properties of the obtained toner are shown in Table 5. Evaluations of the obtained toner were performed in a manner similar to that of Example 1, and the results are shown in Table 6.

Example 3

Except that 1.00 part of the compound CA-3 was used instead of the compound CA-1 in the formation of the pigment dispersed paste of Example 1, a toner 3 was formed in a manner similar to that of Example 1. The properties of the obtained toner are shown in Table 5. Evaluations of the obtained toner were performed in a manner similar to that of Example 1, and the results are shown in Table 6.

Example 4

Except that 1.00 part of the compound CA-4 was used instead of the compound CA-1 in the formation of the pigment dispersed paste of Example 1, a toner 4 was formed in a manner similar to that of Example 1. The properties of the obtained toner are shown in Table 5. Evaluations of the obtained toner were performed in a manner similar to that of Example 1, and the results are shown in Table 6.

Example 5

Except that 1.00 part of the compound CA-5 was used instead of the compound CA-1 in the formation of the pigment dispersed paste of Example 1, and that 5.00 parts of the styrene acrylic resin SA-1 was used instead of the polyester PES-1 in the formation of the toner particles, a toner 5 was formed in a manner similar to that of Example 1. The properties of the obtained toner are shown in Table 5. Evaluations of the obtained toner were performed in a manner similar to that of Example 1, and the results are shown in Table 6.

Example 6

Except that 1.00 part of the compound CA-6 was used instead of the compound CA-1 in the formation of the pigment dispersed paste of Example 1, and that 5.00 parts of the styrene acrylic resin SA-1 was used instead of the polyester PES-1 in the formation of the toner particles, a toner 6 was formed in a manner similar to that of Example 1. The properties of the obtained toner are shown in Table 5. Evaluations of the obtained toner were performed in a manner similar to that of Example 1, and the results are shown in Table 6.

Example 7

Except that 1.00 part of the compound CA-7 was used instead of the compound CA-1 in the formation of the pigment dispersed paste of Example 1, a toner 7 was formed in a manner similar to that of Example 1. The properties of the obtained toner are shown in Table 5. Evaluations of the obtained toner were performed in a manner similar to that of Example 1, and the results are shown in Table 6.

Example 8

Except that 1.00 part of the compound CA-8 was used instead of the compound CA-1 in the formation of the pigment dispersed paste of Example 1, a toner 8 was formed in a manner similar to that of Example 1. The properties of the obtained toner are shown in Table 5. Evaluations of the obtained toner were performed in a manner similar to that of Example 1, and the results are shown in Table 6.

Example 9

Except that 1.00 part of the compound CA-9 was used instead of the compound CA-1 in the formation of the pigment dispersed paste of Example 1, a toner 9 was formed in a manner similar to that of Example 1. The properties of the obtained toner are shown in Table 5. Evaluations of the obtained toner were performed in a manner similar to that of Example 1, and the results are shown in Table 6.

Example 10

Except that 1.00 part of the compound CA-10 was used instead of the compound CA-1 in the formation of the pigment dispersed paste of Example 1, a toner 10 was formed in a manner similar to that of Example 1. The properties of the obtained toner are shown in Table 5. Evaluations of the obtained toner were performed in a manner similar to that of Example 1, and the results are shown in Table 6.

Example 11

Formation of Pigment Dispersed Paste:

The following materials were sufficiently pre-mixed together in a container and were then dispersed by a bead mill for 4 hours while the temperature was maintained at 20° C. or less, so that a pigment dispersed paste was formed.

Content Ratio

| | |
|---|---|
| Styrene | 80.0 parts |
| Carbon black | 14.0 parts |
| Compound CA-1 | 1.00 part |

Formation of Toner Particles

After 350 parts of a $Na_3PO_4$ aqueous solution at a concentration of 0.1 mole/l was charged to 1,200 parts of ion exchanged water and was then heated to 60° C. Subsequently, by using Clearmix (manufactured by M-Technique Co., Ltd.), stirring was performed at 11,000 rpm. To this mixture, 52 parts of a $CaCl_2$ aqueous solution at a concentration of 1.0 mole/l was added, so that a dispersion medium containing $Ca_3(PO_4)_2$ was obtained.

The following materials were heated to 60° C. and were then dissolved and dispersed to form a monomer mixture. Furthermore, while this mixture was maintained at 60° C., 5 parts of 2,2'-azobis(2,4-dimethylvaleronitrile) was added thereto as a polymerization initiator and was then dissolved, so that a monomer composition was obtained.

Content Ratio

| | |
|---|---|
| The above pigment dispersed past (In the above pigment dispersed paste, 0.400 parts of the compound CA-1 was contained.) | 38.0 parts |
| Styrene | 30.0 parts |
| n-butyl acrylate | 17.0 parts |
| Ester wax (Primary component: $C_{19}H_{39}COOC_{20}H_{41}$, melting point: 68.6° C.) | 10.0 parts |
| Polyester PES-1 | 5.00 parts |
| Polymer B-1 | 0.600 parts |

After the above monomer composition was charged in the above dispersion medium and was placed in a nitrogen atmosphere at 60° C., stirring was performed at 10,000 rpm for 20 minutes using Clearmix, so that the monomer composition was granulated. Subsequently, a reaction was performed at 60° C. for 5 hours while stirring was performed by a paddle stirring blade. Next, stirring was performed at 80° C. for 5 hours, so that the polymerization was completed. After cooling was performed to room temperature, and $Ca_3(PO_4)_2$ was dissolved by addition of hydrochloric acid, filtration, water washing, and drying were performed, so that toner particles were obtained. Furthermore, the toner particles were sieved, and toner particles having a size of 2 to less than 10 μm were selected, so that toner particles 11 were obtained. In addition, as in the case of Example 1, a hydrophobic silica fine powder was externally added to the toner particles 11, so that a toner 11 was obtained. The properties of the toner 11 are shown in Table 5. In addition, evaluations of the above toner were performed in a manner similar to that of Example 1, and the results are shown in Table 6.

Example 12

Except that 14.0 parts of quinacridone (Pigment Violet 19) was used instead of a colorant, C.I Pigment Blue 15:3, a toner 12 was formed in a manner similar to that of Example 1. The properties of the obtained toner are shown in Table 5. Evaluations of the obtained toner were performed in a manner similar to that of Example 1, and the results are shown in Table 6.

Example 13

Except that 0.600 parts of the polymer B-2 was used instead of the polymer B-1 in the formation of the toner particles of Example 1, a toner 13 was formed in a manner similar to that of Example 1. The properties of the obtained toner are shown in Table 5. Evaluations of the obtained toner were performed in a manner similar to that of Example 1, and the results are shown in Table 6.

Example 14

Except that 0.600 parts of the polymer B-3 was used instead of the polymer B-1 in the formation of the toner particles of Example 1, a toner 14 was formed in a manner similar to that of Example 1. The properties of the obtained toner are shown in Table 5. Evaluations of the obtained toner were performed in a manner similar to that of Example 1, and the results are shown in Table 6.

Example 15

Except that 0.0500 parts of the compound CA-1 was used in the formation of the pigment dispersed paste of Example 1 (in 38.0 parts of the pigment dispersed paste, 0.0532 parts of the compound CA-1 was contained), a toner 15 was formed in a manner similar to that of Example 1. The properties of the obtained toner are shown in Table 5. Evaluations of the obtained toner were performed in a manner similar to that of Example 1, and the results are shown in Table 6.

Example 16

Except that 0.100 parts of the compound CA-1 was used in the formation of the pigment dispersed paste of Example 1 (in 38.0 parts of the pigment dispersed paste, 0.106 parts of the compound CA-1 was contained), a toner 16 was formed in a manner similar to that of Example 1. The properties of the obtained toner are shown in Table 5. Evaluations of the obtained toner were performed in a manner similar to that of Example 1, and the results are shown in Table 6.

Example 17

Except that 0.400 parts of the compound CA-1 was further used in the formation of the pigment dispersed paste of Example 1 (in 38.0 parts of the pigment dispersed paste, 0.400 parts of the compound CA-1 was contained, and in total, 0.800 parts of the compound CA-1 was used), a toner 17 was formed in a manner similar to that of Example 1. The properties of the obtained toner are shown in Table 5. Evaluations of the obtained toner were performed in a manner similar to that of Example 1, and the results are shown in Table 6.

Example 18

Except that 1.60 parts of the compound CA-1 was further used in the formation of the pigment dispersed paste of Example 1 (in 38.0 parts of the pigment dispersed paste, 0.400 parts of the compound CA-1 was contained, and in total, 2.00 parts of the compound CA-1 was used), a toner 18 was formed in a manner similar to that of Example 1. The properties of the obtained toner are shown in Table 5. Evaluations of the obtained toner were performed in a manner similar to that of Example 1, and the results are shown in Table 6.

Example 19

Except that 3.60 parts of the compound CA-1 was further used in the formation of the pigment dispersed paste of Example 1 (in 38.0 parts of the pigment dispersed paste, 0.400 parts of the compound CA-1 was contained, and in total, 4.00 parts of the compound CA-1 was used), a toner 19 was formed in a manner similar to that of Example 1. The properties of the obtained toner are shown in Table 5. Evaluations of the obtained toner were performed in a manner similar to that of Example 1, and the results are shown in Table 6.

Example 20

Except that 4.60 parts of the compound CA-1 was further used in the formation of the pigment dispersed paste of Example 1 (in 38.0 parts of the pigment dispersed paste, 0.400 parts of the compound CA-1 was contained, and in total, 5.00 parts of the compound CA-1 was used), a toner 20 was formed in a manner similar to that of Example 1. The properties of the obtained toner are shown in Table 5. Evaluations of the obtained toner were performed in a manner similar to that of Example 1, and the results are shown in Table 6.

Example 21

Except that 0.0500 parts of the polymer B-1 was used in the formation of the toner particles of Example 1, a toner 21 was formed in a manner similar to that of Example 1. The properties of the obtained toner are shown in Table 5. Evaluations of the obtained toner were performed in a manner similar to that of Example 1, and the results are shown in Table 6.

Example 22

Except that 0.100 parts of the polymer B-1 was used in the formation of the toner particles of Example 1, a toner 22 was formed in a manner similar to that of Example 1. The properties of the obtained toner are shown in Table 5. Evaluations of the obtained toner were performed in a manner similar to that of Example 1, and the results are shown in Table 6.

Example 23

Except that 2.40 parts of the polymer B-1 was used in the formation of the toner particles of Example 1, a toner 23 was formed in a manner similar to that of Example 1. The properties of the obtained toner are shown in Table 5. Evaluations of the obtained toner were performed in a manner similar to that of Example 1, and the results are shown in Table 6.

Example 24

Except that 0.0300 parts of the compound CA-1 was used in the formation of the pigment dispersed paste of Example 1 (in 38.0 parts of the pigment dispersed paste, 0.0319 parts of the compound CA-1 was contained), and that the polymer B-1 was not used in the formation of the toner particles, a toner 24 was formed in a manner similar to that of Example 1. The properties of the obtained toner are shown in Table 5. Evaluations of the obtained toner were performed in a manner similar to that of Example 1, and the results are shown in Table 6.

Example 25

Except that 0.0500 parts of the compound CA-1 was used in the formation of the pigment dispersed paste of Example 1 (in 38.0 parts of the pigment dispersed paste, 0.0532 parts of the compound CA-1 was contained), and that the polymer B-1 was not used in the formation of the toner particles, a toner 25 was formed in a manner similar to that of Example 1. The properties of the obtained toner are shown in Table 5. Evaluations of the obtained toner were performed in a manner similar to that of Example 1, and the results are shown in Table 6.

Example 26

Except that the polymer B-1 was not used in the formation of the toner particles of Example 1, a toner 26 was formed in a manner similar to that of Example 1. The properties of the obtained toner are shown in Table 5. Evaluations of the obtained toner were performed in a manner similar to that of Example 1, and the results are shown in Table 6.

Example 27

Except that 3.60 parts of the compound CA-1 was further used in the formation of the pigment dispersed paste of Example 1 (in 38.0 parts of the pigment dispersed paste, 0.400 parts of the compound CA-1 was contained, and in total, 4.00 parts of the compound CA-1 was used), and that the polymer B-1 was not used, a toner 27 was formed in a manner similar to that of Example 1. The properties of the obtained toner are shown in Table 5. Evaluations of the obtained toner were performed in a manner similar to that of Example 1, and the results are shown in Table 6.

Example 28

Except that 4.80 parts of the compound CA-1 was further used in the formation of the pigment dispersed paste of Example 1 (in 38.0 parts of the pigment dispersed paste, 0.400 parts of the compound CA-1 was contained, and in total, 5.20 parts of the compound CA-1 was used), and that the polymer B-1 was not used, a toner 28 was formed in a manner similar to that of Example 1. The properties of the obtained toner are shown in Table 5. Evaluations of the obtained toner were performed in a manner similar to that of Example 1, and the results are shown in Table 6.

Example 29

Except that 5.60 parts of the compound CA-1 was further used in the formation of the pigment dispersed paste of Example 1 (in 38.0 parts of the pigment dispersed paste, 0.400 parts of the compound CA-1 was contained, and in total, 6.00 parts of the compound CA-1 was used), and that the polymer B-1 was not used, a toner 29 was formed in a manner similar to that of Example 1. The properties of the obtained toner are shown in Table 5. Evaluations of the obtained toner were performed in a manner similar to that of Example 1, and the results are shown in Table 6.

Example 30

Formation of Pigment Dispersed Paste:

The following materials were sufficiently pre-mixed together in a container and were then dispersed by a bead mill for 5 hours while the temperature was maintained at 20° C. or less, so that a pigment dispersed paste was obtained.

Content Ratio

| | |
|---|---|
| Styrene | 80.0 parts |
| C.I. Pigment Blue 15:3 | 14.0 parts |
| Compound CA-1 | 1.00 part |

Formation of Toner Particles

After 390 parts of a $Na_3PO_4$ aqueous solution at a concentration of 0.1 mole/l was charged to 1,150 parts of ion exchanged water and was then heated to 60° C. Subsequently, by using Clearmix (manufactured by M-Technique Co., Ltd.), stirring was performed at 11,000 rpm. To this mixture, 58 parts of a $CaCl_2$ aqueous solution at a concentration of 1.0 mole/l was added, so that a dispersion medium containing $Ca_3(PO_4)_2$ was obtained.

The following materials were heated to 60° C. and were then dissolved and dispersed to form a monomer mixture. Furthermore, while this mixture was maintained at 60° C., 5 parts of 2,2'-azobis(2,4-dimethylvaleronitrile) as a polymerization initiator was added to and dissolved in the mixture, so that a monomer composition was obtained. After the above monomer composition was charged to the above dispersion medium and was placed in a nitrogen atmosphere at 60° C., stirring was performed at 10,000 rpm for 20 minutes using Clearmix, so that the monomer composition was granulated. Subsequently, a reaction was performed at 60° C. for 1 hour while stirring was performed by a paddle stirring blade.

Content Ratio

| | |
|---|---|
| The above pigment dispersed past (In the above pigment dispersed paste, 0.400 parts of the compound CA-1 was contained.) | 38.0 parts |
| Styrene | 34.0 parts |
| n-butyl acrylate | 15.0 parts |
| Paraffin wax (HNP-7, manufactured by Nippon Seiro Co., Ltd. | 8.00 parts |
| Polyester PES-1 | 5.00 parts |

Next, the following materials were heated, melted, and dispersed, so that a monomer mixture was obtained. Furthermore, while the above mixture was maintained at 60° C., 0.500 parts of 2,2'-azobis(2,4-dimethylvaleronitrile) was dissolved as a polymerization initiator, so that a monomer composition was obtained.

| | |
|---|---|
| Styrene | 7.50 parts |
| n-butyl acrylate | 2.50 parts |
| Compound CA-1 | 0.400 parts |

Polymerization was performed by charging this monomer composition to the above dispersion medium. Subsequently, a reaction was performed at 60° C. for 5 hours while stirring was performed by a paddle stirring blade. Next, stirring was performed at 80° C. for 5 hours, so that the polymerization was completed. After cooling was performed to room temperature, and $Ca_3(PO_4)_2$ was dissolved by addition of hydrochloric acid, filtration, water washing, and drying were performed, so that toner particles were obtained. Furthermore, the toner particles were sieved, and toner particles having a size of 2 to less than 10 μm were selected, so that toner particles 30 were obtained. In addition, as in the case of Example 1, a hydrophobic silica fine powder was externally added to the toner particles 30, so that a toner 30 was obtained. The properties of the obtained toner are shown in Table 5. In addition, evaluations of the above toner were performed in a manner similar to that of Example 1, and the results are shown in Table 6.

Example 31

Except that 1.00 part of the compound CA-11 was used instead of the compound CA-1 in the formation of the pigment dispersed paste of Example 1 (in 38.0 parts of the pigment dispersed paste, 0.400 parts of the compound CA-1 was contained), and that the polymer B-1 was not used in the formation of the toner particles, a toner 31 was formed in a manner similar to that of Example 1. The properties of the obtained toner are shown in Table 5. Evaluations of the obtained toner were performed in a manner similar to that of Example 1, and the results are shown in Table 6.

Comparative Example 1

Except that the compound CA-1 was not used in the formation of the pigment dispersed paste of Example 1, and that the polymer B-1 was not used in the formation of the toner particles, a toner was formed in a manner similar to that of Example 1, so that a toner 32 of Comparative Example 1 was obtained. The properties of the obtained toner are shown in Table 5. Evaluations of the obtained toner were performed in a manner similar to that of Example 1, and the results are shown in Table 6.

Comparative Example 2

Except that the compound CA-1 was not used in the formation of the pigment dispersed paste of Example 1, a toner was formed in a manner similar to that of Example 1, so that a toner 33 of Comparative Example 2 was obtained. The properties of the obtained toner are shown in Table 5. Evaluations of the obtained toner were performed in a manner similar to that of Example 1, and the results are shown in Table 6.

Comparative Example 3

Except that the compound CA-1 was not used in the formation of the pigment dispersed paste of Example 11, a toner was formed in a manner similar to that of Example 11, so that a toner 34 of Comparative Example 3 was obtained. The properties of the obtained toner are shown in Table 5. Evaluations of the obtained toner were performed in a manner similar to that of Example 1, and the results are shown in Table 6.

Comparative Example 4

Except that the compound CA-1 was not used in the formation of the pigment dispersed paste of Example 12, a toner was formed in a manner similar to that of Example 12, so that a toner 35 of Comparative Example 4 was obtained. The properties of the obtained toner are shown in Table 5. Evaluations of the obtained toner were performed in a manner similar to that of Example 1, and the results are shown in Table 6.

Comparative Example 5

Except that in the formation of the pigment dispersed paste of Example 1, the compound CA-1 was not used, 1.00 part of a boron compound of an aromatic oxycarboxylic acid LR-147 (manufactured by Japan Carlit Co., Ltd.) was used, and in the formation of the toner particles, the polymer B-1 was not used, a toner was formed in a manner similar to that of Example 1, so that a toner 36 of Comparative Example 5 was obtained. The properties of the obtained toner are shown in Table 5. Evaluations of the obtained toner were performed in a manner similar to that of Example 1, and the results are shown in Table 6.

Comparative Example 6

Except that in the formation of the pigment dispersed paste of Example 1, the compound CA-1 was not used, 1.00 part of an aluminum compound of an aromatic oxycarboxylic acid Bontron E-88 (manufactured by Orient Chemical Industries Co., Ltd.) was used, and in the formation of the toner particles, the polymer B-1 was not used, a toner was formed in a manner similar to that of Example 1, so that a toner 37 of Comparative Example 6 was obtained. The properties of the obtained toner are shown in Table 5. Evaluations of the obtained toner were performed in a manner similar to that of Example 1, and the results are shown in Table 6.

Comparative Example 7

A meal compound CA-12 was synthesized by the following method.

Except that the aromatic compound A-1 was changed to 2-hydroxy-5-phenoxybenzoic acid represented by the following formula (A-9), the metal compound CA-12 was obtained by a method similar to that for the metal compound CA-1 having a vinyl group. The amount of aluminum of the metal compound CA-12 was quantitatively determined by a fluorescent x-ray analysis. The content of aluminum was 5.60 percent by mass.

[Chemical 40]

Formula (A-9)

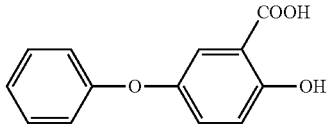

Except that 1.00 part of the compound CA-12 was used instead of the compound CA-1 in the formation of the pigment dispersed paste of Example 1, and that the polymer B-1 was not used in the formation of the toner particles, a toner was formed in a manner similar to that of Example 1, so that a toner 38 of Comparative Example 7 was obtained. The properties of the obtained toner are shown in Table 5. Evaluations of the obtained toner were performed in a manner similar to that of Example 1, and the results are shown in Table 6.

Comparative Example 8

A metal compound CA-13 was synthesized by the following method.

After 25.0 g of 2,3-dihydroxybenzoic acid was dissolved in 160 ml of methanol, 40.00 g of potassium carbonate was added thereto, and heating was then performed to 65° C. To this solution, 39.9 g of 1-bromopropane was dripped, and a reaction was performed at 65° C. for 12 hours. An obtained reaction liquid was cooled, and methanol was distilled away at a reduced pressure, so that a residue was obtained. The obtained residue was dispersed in 3 liters of water adjusted with hydrochloric acid to have a pH of 2 and was then extracted into an ethyl acetate phase by addition of ethyl acetate. Subsequently, after washing with water and drying with magnesium sulfate were performed, ethyl acetate was distilled away at a reduced pressure, so that a precipitate was obtained. After the obtained precipitate was washed with hexane, recrystallization was performed using toluene/ethyl acetate, so that 22.1 g of an aromatic compound represented by the following formula (A-10) was obtained.

[Chemical 41]

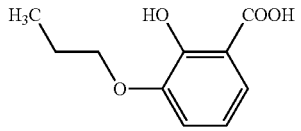

Formula (A-10)

Next, except that the aromatic compound A-1 was changed to the aromatic compound A-10, the metal compound CA-13 was obtained by a method similar to that for the metal compound CA-1 having a vinyl group. The amount of the metal compound CA-13 was quantitatively determined by a fluorescent x-ray analysis. The content of aluminum was 4.81 percent by mass.

Except that 1.00 part of the compound CA-13 was used instead of the compound CA-1 in the formation of the pigment dispersed paste of Example 1, and that the polymer B-1 was not used in the formation of the toner particles, a toner was formed in a manner similar to that of Example 1, so that a toner 39 of Comparative Example 8 was obtained. The properties of the toner are shown in Table 5. Evaluations of the above toner were performed in a manner similar to that of Example 1, and the results are shown in Table 6.

TABLE 5

| | | TONER | | | | | | |
|---|---|---|---|---|---|---|---|---|
| | | AROMATIC COMPOUND HAVING VINYL GROUP | | METAL CONTENT IN | POLYMER | SULFUR CONTENT b IN | | TONER PARTICLE DIAMETER |
| | | AROMATIC COMPOUND A | TYPE OF METAL | TONER (μ mol/g) | HAVING STRUCTURE B | TONER (μ mol/g) | COLORANT | (D4) (μm) |
| EXAMPLE 1 | TONER 1 | CA-1 | Al | 8.10 | B-1 | 1.56 | C.I.Pig.Blue15:3 | 6.8 |
| EXAMPLE 2 | TONER 2 | CA-2 | Al | 6.08 | B-1 | 1.56 | C.I.Pig.Blue15:3 | 6.7 |
| EXAMPLE 3 | TONER 3 | CA-3 | Al | 4.91 | B-1 | 1.56 | C.I.Pig.Blue15:3 | 6.8 |
| EXAMPLE 4 | TONER 4 | CA-4 | Al | 6.43 | B-1 | 1.56 | C.I.Pig.Blue15:3 | 6.8 |
| EXAMPLE 5 | TONER 5 | CA-5 | Al | 8.27 | B-1 | 1.56 | C.I.Pig.Blue15:3 | 6.7 |
| EXAMPLE 6 | TONER 6 | CA-6 | Al | 6.44 | B-1 | 1.56 | C.I.Pig.Blue15:3 | 6.8 |
| EXAMPLE 7 | TONER 7 | CA-7 | Al | 7.94 | B-1 | 1.56 | C.I.Pig.Blue15:3 | 6.8 |
| EXAMPLE 8 | TONER 8 | CA-8 | Al | 5.88 | B-1 | 1.56 | C.I.Pig.Blue15:3 | 6.7 |
| EXAMPLE 9 | TONER 9 | CA-9 | Zn | 9.12 | B-1 | 1.56 | C.I.Pig.Blue15:3 | 6.9 |
| EXAMPLE 10 | TONER 10 | CA-10 | Cr | 9.14 | B-1 | 1.56 | C.I.Pig.Blue15:3 | 6.8 |
| EXAMPLE 11 | TONER 11 | CA-1 | Al | 8.11 | B-1 | 1.56 | CB | 6.7 |
| EXAMPLE 12 | TONER 12 | CA-1 | Al | 8.10 | B-1 | 1.56 | C.I.Pig.Violet19 | 6.7 |
| EXAMPLE 13 | TONER 13 | CA-1 | Al | 8.13 | B-2 | 3.10 | C.I.Pig.Blue15:3 | 6.8 |
| EXAMPLE 14 | TONER 14 | CA-1 | Al | 8.12 | B-3 | 3.20 | C.I.Pig.Blue15:3 | 6.8 |
| EXAMPLE 15 | TONER 15 | CA-1 | Al | 1.01 | B-1 | 1.57 | C.I.Pig.Blue15:3 | 6.8 |
| EXAMPLE 16 | TONER 16 | CA-1 | Al | 2.04 | B-1 | 1.57 | C.I.Pig.Blue15:3 | 6.9 |
| EXAMPLE 17 | TONER 17 | CA-1 | Al | 16.0 | B-1 | 1.56 | C.I.Pig.Blue15:3 | 6.8 |
| EXAMPLE 18 | TONER 18 | CA-1 | Al | 39.3 | B-1 | 1.54 | C.I.Pig.Blue15:3 | 6.8 |
| EXAMPLE 19 | TONER 19 | CA-1 | Al | 75.2 | B-1 | 3.00 | C.I.Pig.Blue15:3 | 6.9 |
| EXAMPLE 20 | TONER 20 | CA-1 | Al | 95.7 | B-1 | 2.97 | C.I.Pig.Blue15:3 | 6.9 |
| EXAMPLE 21 | TONER 21 | CA-1 | Al | 8.16 | B-1 | 0.13 | C.I.Pig.Blue15:3 | 6.8 |
| EXAMPLE 22 | TONER 22 | CA-1 | Al | 8.10 | B-1 | 0.26 | C.I.Pig.Blue15:3 | 6.8 |
| EXAMPLE 23 | TONER 23 | CA-1 | Al | 7.96 | B-1 | 6.14 | C.I.Pig.Blue15:3 | 6.8 |
| EXAMPLE 24 | TONER 24 | CA-1 | Al | 0.65 | — | — | C.I.Pig.Blue15:3 | 6.8 |
| EXAMPLE 25 | TONER 25 | CA-1 | Al | 1.08 | — | — | C.I.Pig.Blue15:3 | 6.8 |
| EXAMPLE 26 | TONER 26 | CA-1 | Al | 8.16 | — | — | C.I.Pig.Blue15:3 | 6.9 |
| EXAMPLE 27 | TONER 27 | CA-1 | Al | 76.1 | — | — | C.I.Pig.Blue15:3 | 6.9 |
| EXAMPLE 28 | TONER 28 | CA-1 | Al | 96.7 | — | — | C.I.Pig.Blue15:3 | 6.9 |
| EXAMPLE 29 | TONER 29 | CA-1 | Al | 110.0 | — | — | C.I.Pig.Blue15:3 | 6.9 |
| EXAMPLE 30 | TONER 30 | CA-1 | Al | 14.8 | — | — | C.I.Pig.Blue15:3 | 6.9 |
| EXAMPLE 31 | TONER 31 | CA-11 | Al | 7.44 | — | — | C.I.Pig.Blue15:3 | 6.8 |
| COMPARATIVE EXAMPLE 1 | TONER 32 | — | — | — | — | — | C.I.Pig.Blue15:3 | 6.7 |
| COMPARATIVE EXAMPLE 2 | TONER 33 | — | — | — | B-1 | 1.57 | C.I.Pig.Blue15:3 | 6.8 |
| COMPARATIVE EXAMPLE 3 | TONER 34 | — | — | — | B-1 | 1.57 | CB | 6.8 |
| COMPARATIVE EXAMPLE 4 | TONER 35 | — | — | — | B-1 | 1.57 | C.I.Pig.Violet19 | 6.9 |
| COMPARATIVE EXAMPLE 5 | TONER 36 | As a charge control agent, a boron compound of an aromatic dicarboxylic acid, LR-147, is used. | | | — | — | C.I.Pig.Blue15:3 | 6.8 |
| COMPARATIVE EXAMPLE 6 | TONER 37 | As a charge control agent, an aluminum compound of an aromatic dicarboxylic acid, Bontron E-88, is used. | | | — | — | C.I.Pig.Blue15:3 | 6.7 |
| COMPARATIVE EXAMPLE 7 | TONER 38 | CA-12 | Al | 8.31 | — | — | C.I.Pig.Blue15:3 | 6.6 |
| COMPARATIVE EXAMPLE 8 | TONER 39 | CA-13 | Al | 7.15 | — | — | C.I.Pig.Blue15:3 | 6.7 |

TABLE 6

| | | EVALUATION RESULT | | | | | | | |
|---|---|---|---|---|---|---|---|---|---|
| | | SATURATED CHARGE AMOUNT IN HIGH TEMPERATURE AND HIGH HUMIDITY (H/H) ENVIRONMENT | | DIFFERENCE IN SATURATED CHARGE AMOUNT BETWEEN ENVIRONMENTS | | TONER CHARGE RISE CHARACTERISTIC ON TWO-COMPONENT DEVELOPING SLEEVE IN HIGH TEMPERATURE AND HIGH HUMIDITY (H/H) ENVIRONMENT | | | |
| | | μC/g | EVALUATION RANK | (HH/LL) RATIO | EVALUATION RANK | (Q5 min/Q2 min) RATIO | EVALUATION RANK | (Q5 min/Q2 min) RATIO | EVALUATION RANK |
| EXAMPLE 1 | TONER 1 | −88.3 | A | 1.08 | A | 1.13 | A | 1.05 | A |
| EXAMPLE 2 | TONER 2 | −84.5 | A | 1.10 | A | 1.14 | A | 1.07 | A |
| EXAMPLE 3 | TONER 3 | −78.5 | A | 1.15 | A | 1.18 | A | 1.12 | A |
| EXAMPLE 4 | TONER 4 | −85.3 | A | 1.11 | A | 1.15 | A | 1.07 | A |
| EXAMPLE 5 | TONER 5 | −84.5 | A | 1.12 | A | 1.16 | A | 1.08 | A |
| EXAMPLE 6 | TONER 6 | −86.1 | A | 1.11 | A | 1.16 | A | 1.08 | A |
| EXAMPLE 7 | TONER 7 | −87.8 | A | 1.09 | A | 1.14 | A | 1.06 | A |
| EXAMPLE 8 | TONER 8 | −88.5 | A | 1.08 | A | 1.14 | A | 1.06 | A |
| EXAMPLE 9 | TONER 9 | −70.5 | A | 1.23 | A | 1.38 | B | 1.25 | B |
| EXAMPLE 10 | TONER 10 | −78.9 | A | 1.21 | A | 1.33 | B | 1.18 | A |
| EXAMPLE 11 | TONER 11 | −86.5 | A | 1.08 | A | 1.13 | A | 1.06 | A |
| EXAMPLE 12 | TONER 12 | −88.8 | A | 1.10 | A | 1.14 | A | 1.07 | A |
| EXAMPLE 13 | TONER 13 | −89.1 | A | 1.12 | A | 1.16 | A | 1.09 | A |
| EXAMPLE 14 | TONER 14 | −93.5 | A | 1.08 | A | 1.15 | A | 1.07 | A |
| EXAMPLE 15 | TONER 15 | −50.1 | B | 1.33 | B | 1.28 | B | 1.16 | A |
| EXAMPLE 16 | TONER 16 | −60.1 | A | 1.12 | A | 1.17 | A | 1.09 | A |
| EXAMPLE 17 | TONER 17 | −89.6 | A | 1.08 | A | 1.14 | A | 1.06 | A |
| EXAMPLE 18 | TONER 18 | −90.3 | A | 1.11 | A | 1.13 | A | 1.07 | A |
| EXAMPLE 19 | TONER 19 | −94.5 | A | 1.12 | A | 1.18 | A | 1.10 | A |
| EXAMPLE 20 | TONER 20 | −98.0 | A | 1.18 | A | 1.34 | B | 1.18 | A |
| EXAMPLE 21 | TONER 21 | −77.0 | A | 1.15 | A | 1.16 | A | 1.07 | A |
| EXAMPLE 22 | TONER 22 | −80.3 | A | 1.10 | A | 1.12 | A | 1.05 | A |
| EXAMPLE 23 | TONER 23 | −94.5 | A | 1.11 | A | 1.13 | A | 1.06 | A |
| EXAMPLE 24 | TONER 24 | −32.5 | C | 1.40 | B | 1.54 | C | 1.38 | B |
| EXAMPLE 25 | TONER 25 | −44.0 | C | 1.36 | B | 1.38 | B | 1.25 | B |
| EXAMPLE 26 | TONER 26 | −75.0 | A | 1.10 | A | 1.21 | B | 1.12 | A |
| EXAMPLE 27 | TONER 27 | −85.1 | A | 1.12 | A | 1.22 | B | 1.13 | A |
| EXAMPLE 28 | TONER 28 | −91.2 | A | 1.18 | A | 1.40 | B | 1.26 | B |
| EXAMPLE 29 | TONER 29 | −94.2 | A | 1.21 | A | 1.52 | C | 1.30 | B |
| EXAMPLE 30 | TONER 30 | −75.5 | A | 1.09 | A | 1.19 | A | 1.09 | A |
| EXAMPLE 31 | TONER 31 | −74.1 | A | 1.26 | A | 1.53 | C | 1.34 | B |
| COMPARATIVE EXAMPLE 1 | TONER 32 | −12.2 | E | 2.20 | D | 2.48 | E | 2.23 | E |
| COMPARATIVE EXAMPLE 2 | TONER 33 | −26.8 | D | 2.14 | D | 2.10 | E | 1.70 | D |
| COMPARATIVE EXAMPLE 3 | TONER 34 | −24.3 | D | 1.94 | C | 2.13 | E | 1.75 | D |
| COMPARATIVE EXAMPLE 4 | TONER 35 | −27.2 | D | 2.21 | D | 2.25 | E | 1.80 | D |
| COMPARATIVE EXAMPLE 5 | TONER 36 | −25.8 | D | 1.85 | C | 2.29 | E | 1.86 | D |
| COMPARATIVE EXAMPLE 6 | TONER 37 | −58.1 | B | 1.42 | B | 1.54 | C | 1.32 | B |
| COMPARATIVE EXAMPLE 7 | TONER 38 | −43.3 | C | 1.65 | C | 2.05 | E | 1.65 | D |
| COMPARATIVE EXAMPLE 8 | TONER 39 | −38.1 | C | 2.10 | D | 2.12 | E | 1.75 | D |

TABLE 6-continued

| | | EVALUATION RESULT | | | | |
|---|---|---|---|---|---|---|
| | | CHARGE STABILITY BEFORE AND AFTER STORAGE IN HIGH TEMPERATURE AND HIGH HUMIDITY (H/H) ENVIRONMENT (50° C./95% RH/3 DAYS) VALUE AFTER 200 TIMES OF SHAKING | | VISUAL EVALU- | | |
| | | (CHARGE AFTER STORAGE/ CHARGE | | ATION OF PIGMENT DISPERS- IBILITY | REPRODUCIBILITY OF HALFTONE | |
| | | BEFORE STORAGE RATIO) | EVALU- ATION RANK | EVALU- ATION RANK | c*(70)/ L*(50) | EVALU- ATION RANK |
| EXAMPLE 1 | TONER | 0.90 | A | A | 37.0/67.0 | A |
| EXAMPLE 2 | TONER 2 | 0.87 | A | A | 36.8/66.5 | A |
| EXAMPLE 3 | TONER 3 | 0.85 | A | A | 34.8/65.2 | A |
| EXAMPLE 4 | TONER 4 | 0.87 | A | A | 36.0/65.2 | A |
| EXAMPLE 5 | TONER 5 | 0.87 | A | A | 36.6/66.3 | A |
| EXAMPLE 6 | TONER 6 | 0.84 | B | A | 36.8/66.6 | A |
| EXAMPLE 7 | TONER 7 | 0.87 | A | A | 36.9/66.9 | A |
| EXAMPLE 8 | TONER 8 | 0.86 | A | A | 37.1/67.1 | A |
| EXAMPLE 9 | TONER 9 | 0.81 | B | B | 36.3/63.0 | B |
| EXAMPLE 10 | TONER 10 | 0.85 | A | A | 36.2/64.8 | B |
| EXAMPLE 11 | TONER 11 | 0.86 | A | A | 1.08 (*1) | A |
| EXAMPLE 12 | TONER 12 | 0.83 | B | A | 33.7/63.5 | B |
| EXAMPLE 13 | TONER 13 | 0.88 | A | A | 37.0/67.0 | A |
| EXAMPLE 14 | TONER 14 | 0.89 | A | A | 37.1/67.1 | A |
| EXAMPLE 15 | TONER 15 | 0.83 | B | B | 35.1/65.2 | A |
| EXAMPLE 16 | TONER 16 | 0.87 | A | A | 35.3/66.0 | A |
| EXAMPLE 17 | TONER 17 | 0.91 | A | A | 37.1/67.1 | A |
| EXAMPLE 18 | TONER 18 | 0.90 | A | A | 37.1/67.0 | A |
| EXAMPLE 19 | TONER 19 | 0.91 | A | A | 36.7/66.5 | A |
| EXAMPLE 20 | TONER 20 | 0.91 | A | A | 36.2/66.4 | A |
| EXAMPLE 21 | TONER 21 | 0.88 | A | A | 37.1/66.9 | A |
| EXAMPLE 22 | TONER 22 | 0.88 | A | A | 36.9/67.1 | A |
| EXAMPLE 23 | TONER 23 | 0.89 | A | A | 37.0/67.0 | A |
| EXAMPLE 24 | TONER 24 | 0.81 | B | B | 35.0/63.0 | B |
| EXAMPLE 25 | TONER 25 | 0.84 | B | B | 35.2/65.2 | A |
| EXAMPLE 26 | TONER 26 | 0.89 | A | A | 36.9/67.0 | A |
| EXAMPLE 27 | TONER 27 | 0.91 | A | A | 36.8/66.8 | A |
| EXAMPLE 28 | TONER 28 | 0.91 | A | A | 36.3/66.3 | A |
| EXAMPLE 29 | TONER 29 | 0.90 | A | A | 36.0/66.1 | A |
| EXAMPLE 30 | TONER 30 | 0.91 | A | A | 36.8/66.8 | A |
| EXAMPLE 31 | TONER 31 | 0.83 | B | A | 36.7/66.5 | A |
| COMPAR- ATIVE EXAMPLE 1 | TONER 32 | 0.77 | C | C | 29.6/60.6 | C |
| COMPAR- ATIVE EXAMPLE 2 | TONER 33 | 0.76 | C | C | 29.8/60.8 | C |
| COMPAR- ATIVE EXAMPLE 3 | TONER 34 | 0.77 | C | C | 1.40 (*1) | C |
| COMPAR- ATIVE EXAMPLE 4 | TONER 35 | 0.72 | C | C | 31.0/58.0 | C |
| COMPAR- ATIVE EXAMPLE 5 | TONER 36 | 0.82 | B | C | 29.7/60.8 | C |
| COMPAR- ATIVE EXAMPLE 6 | TONER 37 | 0.68 | D | B | 35.5/64.6 | B |
| COMPAR- ATIVE EXAMPLE 7 | TONER 38 | 0.82 | B | A | 36.0/66.0 | A |
| COMPAR- ATIVE EXAMPLE 8 | TONER 39 | 0.67 | D | B | 34.0/63.8 | B |

In the table, "*" represents the black toner evaluation by the ratio of (D0.4 − D0.3)/(D0.7).

As has thus been described, it is found that the toner of the present invention is an excellent toner in which the charge amount and the charge rise characteristic are not likely to be influenced by the change in temperature and humidity environment.

In addition, the toner of the present invention is an excellent toner in which a pigment is preferably dispersed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-196807, Sep. 9, 2011, which is hereby incorporated by reference herein in its entirety.

Reference Signs List

1 suction device, 2 measurement container, 3 screen, 4 lid, 5 vacuum meter, 6 flow rate control valve, 7 suction port, 8 capacitor, 9 electrometer

The invention claimed is:

1. A toner comprising:

toner particles which are produced by a process including the steps of dispersing a monomer composition containing a polymerizable monomer and a pigment in an aqueous medium to form droplets and polymerizing the polymerizable monomer in the droplets, wherein each of the toner particles contains a polymer formed by a polymerization reaction of the polymerizable monomer and a metal compound having a vinyl group, and the metal compound having a vinyl group is a compound having a structure in which a site derived from —$COOM^1$ and/or —OH of a salicylic acid portion or a salicylic acid derivative portion of an aromatic compound represented by the following formula (1) is bonded to a metal

[Chemical 1]

Formula (1)

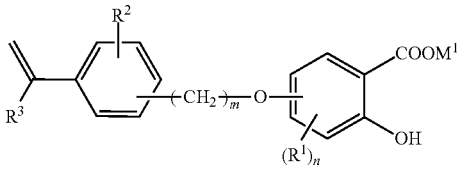

where, in the formula, $R^1$ represents a hydroxyl group, a carboxyl group, an alkyl group having 1 to 18 carbon atoms, or an alkoxy group having 1 to 18 carbon atoms, $R^2$ represents a hydrogen atom, a hydroxyl group, an alkyl group having 1 to 18 carbon atoms, or an alkoxy group having 1 to 18 carbon atoms, $R^3$ represents a hydrogen atom or a methyl group, m is an integer of 1 to 3, n is an integer of 0 to 3 in which when n is 2 or 3, each $R^1$ is independently selected, and $M^1$ represents a hydrogen atom, an alkali metal, $NH_4$, or a mixture thereof.

2. The toner according to claim 1, wherein the metal compound having a vinyl group includes a metal, and the metal is Zn, Al, Si, B, Fe, Cr, or Zr.

3. The toner according to claim 1, wherein the metal compound having a vinyl group includes a metal, and the metal is Zn, Al, or Cr.

4. The toner according to claim 1, wherein a metal derived from the metal compound having a vinyl group is present in an amount of 1.00 to 100 μmol with respect to 1 g of the toner.

5. The toner according to claim 1, further comprising a polymer having a structure B represented by formula (21)

[Chemical 2]

Formula (21)

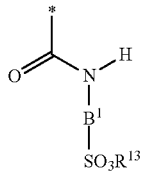

wherein, in the formula, $R^{13}$ represents hydrogen or an alkyl group having 1 to 12 carbon atoms, $B^1$ represents a substituted or unsubstituted alkylene structure having 1 or 2 carbon atoms, a substituted or unsubstituted phenylene structure, or a substituted or unsubstituted naphthylene structure, the substitute of the alkylene structure is a hydroxyl group, an alkyl group having 1 to 12 carbon atoms, a phenyl group, a naphthyl group, or an alkoxy group having 1 to 12 carbon atoms, the substitutes of the phenylene structure and the naphthylene structure are each a hydroxyl group, an alkyl group having 1 to 12 carbon atoms, or an alkoxy group having 1 to 12 carbon atoms, and

* represents a bonding position to a main chain of the polymer.

* * * * *